US009592979B2

(12) United States Patent
Kakuta

(10) Patent No.: US 9,592,979 B2
(45) Date of Patent: Mar. 14, 2017

(54) SHEET FEEDER, AND IMAGE FORMING DEVICE PROVIDED THEREWITH

(71) Applicant: KYOCERA Document Solutions Inc., Osaka-shi, Osaka (JP)

(72) Inventor: Masayuki Kakuta, Osaka (JP)

(73) Assignee: KYOCERA DOCUMENT SOLUTIONS INC., Osaka-shi, Osaka (JP)

( * ) Notice: Subject to any disclaimer, the term of this patent is extended or adjusted under 35 U.S.C. 154(b) by 0 days.

(21) Appl. No.: 14/913,864

(22) PCT Filed: Oct. 6, 2014

(86) PCT No.: PCT/JP2014/076739

§ 371 (c)(1),
(2) Date: Feb. 23, 2016

(87) PCT Pub. No.: WO2015/072246

PCT Pub. Date: May 21, 2015

(65) Prior Publication Data

US 2016/0332833 A1 Nov. 17, 2016

(30) Foreign Application Priority Data

Nov. 13, 2013 (JP) ..... 2013-235132

(51) Int. Cl.
*B65H 1/04* (2006.01)
*B65H 7/02* (2006.01)

(52) U.S. Cl.
CPC ..... *B65H 7/02* (2013.01); *B65H 1/04* (2013.01); *B65H 2511/20* (2013.01);
(Continued)

(58) Field of Classification Search
CPC ..... B65H 2553/612; B65H 2553/82; B65H 2553/412
(Continued)

(56) References Cited

U.S. PATENT DOCUMENTS 6,027,111 A * 2/2000 Rubscha ..... B65H 1/04 271/123
7,445,209 B2 * 11/2008 Sano ..... B65H 7/125 271/145
(Continued)

FOREIGN PATENT DOCUMENTS

JP 5-40017 2/1993
JP 8-301457 11/1996
(Continued)

OTHER PUBLICATIONS

International Search Report.

*Primary Examiner* — Patrick Cicchino
(74) *Attorney, Agent, or Firm* — Gerald E. Hespos; Michael J. Porco; Matthew T. Hespos

(57) ABSTRACT

A sheet feeder includes a tray, a paper feed member, a first detection section, and a second detection section. The tray has a placement surface having an upper surface on which a sheet is placed. The paper feed member is arranged on an entrance side of a sheet conveyance path and conveys the sheet in a conveyance direction. The first detection section detects a leading end side in the conveyance direction of the sheet placed on the placement surface. The second detection section detects a trailing end side in the conveyance direction of the sheet placed on the placement surface. The second detection section is arranged at an end section of the tray on a trailing end side in the conveyance direction.

9 Claims, 16 Drawing Sheets

(52) U.S. Cl.
CPC .. *B65H 2511/212* (2013.01); *B65H 2511/416* (2013.01); *B65H 2553/412* (2013.01); *B65H 2553/414* (2013.01); *B65H 2553/612* (2013.01); *B65H 2801/06* (2013.01); *B65H 2801/39* (2013.01)

(58) Field of Classification Search
USPC ..... 271/145, 31, 38
See application file for complete search history.

(56) References Cited

U.S. PATENT DOCUMENTS

| | | | | |
|---|---|---|---|---|
| 7,547,017 | B2 * | 6/2009 | Mizubata | B65H 1/04 271/10.02 |
| 7,748,693 | B2 * | 7/2010 | Matsumoto | B65H 3/0607 271/10.03 |
| 2002/0044308 | A1 * | 4/2002 | Sekiya | B65H 7/14 358/509 |
| 2004/0056413 | A1 * | 3/2004 | Shirakura | B65H 1/04 271/145 |
| 2007/0176352 | A1 | 8/2007 | Motoyoshi et al. | |
| 2015/0336756 | A1 * | 11/2015 | Lee | B65H 3/0684 271/110 |
| 2015/0336759 | A1 * | 11/2015 | Tsuyuki | B65H 7/18 271/258.01 |
| 2016/0060056 | A1 * | 3/2016 | Yoshimura | B65H 7/06 271/3.18 |
| 2016/0101954 | A1 * | 4/2016 | Takahashi | H04N 1/00482 271/265.03 |

FOREIGN PATENT DOCUMENTS

| | | |
|---|---|---|
| JP | 11-292344 | 10/1999 |
| JP | 2002-347986 | 12/2002 |
| JP | 2007-197168 | 8/2007 |
| JP | 2008-265976 | 11/2008 |

* cited by examiner

SHEET FEEDER, AND IMAGE FORMING DEVICE PROVIDED THEREWITH

TECHNICAL FIELD

The present invention relates to a sheet feeder that feeds a sheet and to an image forming device provided with the sheet feeder.

BACKGROUND ART

Conventionally, an automatic document feeder arranged in an image forming device may be cited as an example of a sheet feeder that feeds a sheet. Such an automatic document feeder includes a document feed tray, a document conveyance section, and a document discharge tray. When a document (sheet) is placed on the document feed tray, the document is conveyed by the document conveyance section so as to pass a predetermined document reading position. The document from which a document image is read at the document reading position is discharged to the document discharge tray.

A size detection section that detects a size of a document placed on the document feed tray is arranged in the automatic document feeder described above. A size of the document in a width direction thereof is detected by a detection mechanism interlocked with a cursor that restricts a position of the document. Meanwhile, a size of the document in a paper feed direction is detected by a detection sensor arranged at a predetermined position of the document feed tray. The detection sensor irradiates detection light upward and receives detection light reflected by the document. The size of the document in the paper feed direction is detected based on a detection result of the detection sensor. Japanese Unexamined Patent Publication No. H8-301457 discloses a technique including a suction mechanism that suctions a risen document toward a side of a document feed tray in order to reliably detect a size of the document when a plurality of sheets are placed on the document feed tray.

SUMMARY OF INVENTION

When an A3 size sheet is bound together with an A4 size sheet, the A3 size sheet may be Z-folded. With a Z-fold, an A3 size sheet is mountain-folded at a center portion in a longitudinal direction and, subsequently, a half region in the longitudinal direction is folded back and mountain-folded. When an A3 size sheet having been Z-folded in this manner is placed on a document feed tray, since a crease made by the Z-fold remains, a trailing end side of the sheet in a paper feed direction is bent in a mountain shape. In this case, with the technique disclosed in Japanese Unexamined Patent Publication No. H8-301457, there is a problem in that a sheet surface separated from the suction mechanism cannot be suctioned and size detection of the sheet cannot be properly performed.

An object of the present invention is to provide a sheet feeder capable of accurately detecting a size of a Z-folded sheet and an image forming device provided with the sheet feeder.

A sheet feeder according to an aspect of the present invention includes: a case; a tray which is arranged in the case and which has a placement surface having an upper surface on which a sheet is placed; a sheet conveyance path which extends from the tray in the case and through which the sheet is conveyed in a predetermined conveyance direction; a paper feed member which is arranged on an entrance side of the sheet conveyance path and which conveys the sheet in the conveyance direction; a first detection section which detects a leading end side in the conveyance direction of the sheet placed on the placement surface; and a second detection section which is arranged at an end section of the tray on a trailing end side in the conveyance direction and which detects a trailing end side in the conveyance direction of the sheet placed on the placement surface.

An image forming device according to another aspect of the present invention includes: the sheet feeder described above which conveys the sheet as a document; an image reading section which is arranged so as to oppose a predetermined image reading position arranged on the sheet conveyance path and which reads a document image of the sheet; and an image forming section which forms an image on a sheet in accordance with the document image read by the image reading section.

According to the present invention, a sheet feeder capable of accurately detecting a size of a Z-folded sheet and an image forming device provided with the sheet feeder are provided.

DESCRIPTION OF EMBODIMENTS

Figure 1:
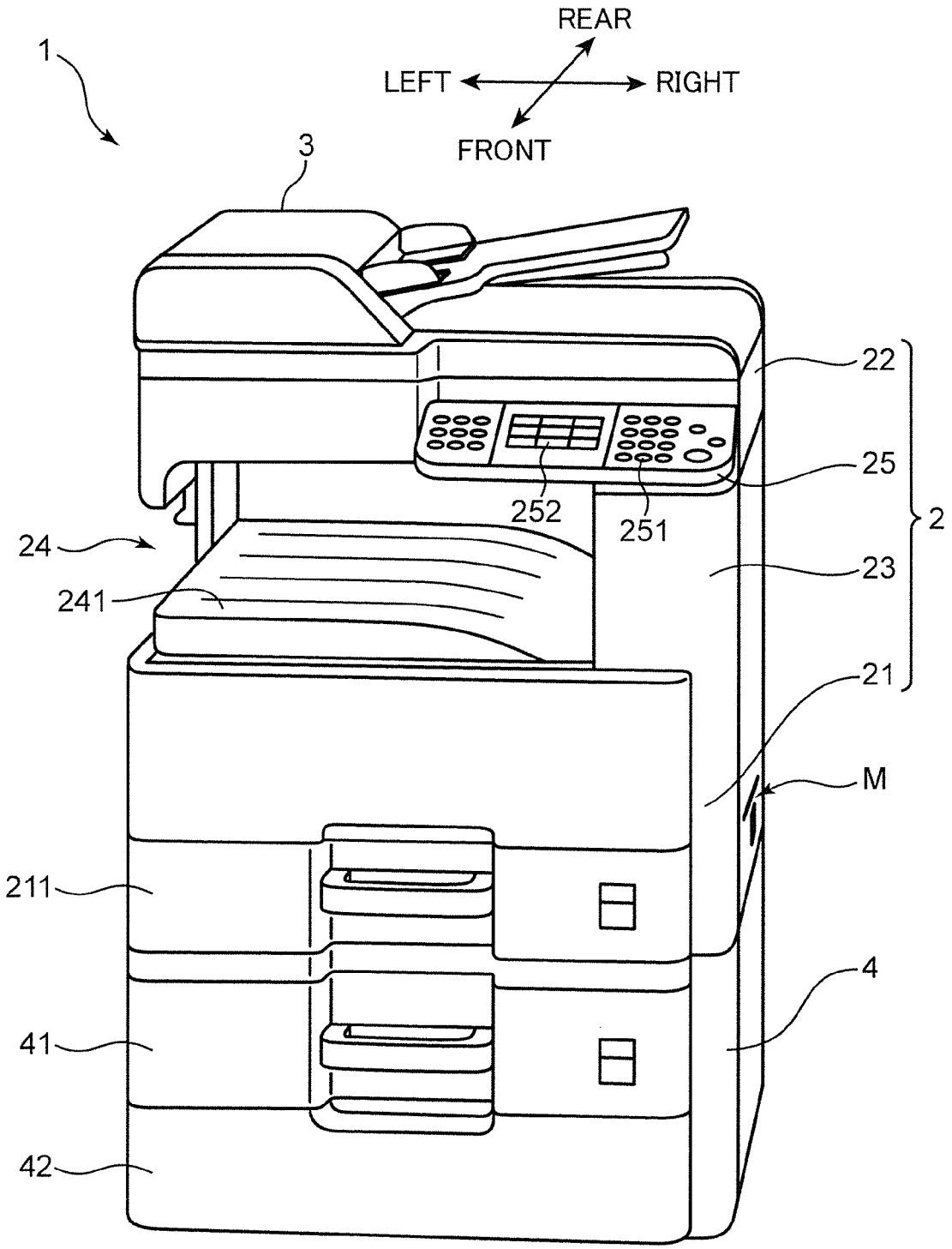
FIG. 1 is a perspective view of an image forming device according to an embodiment of the present invention.
Figure 2:
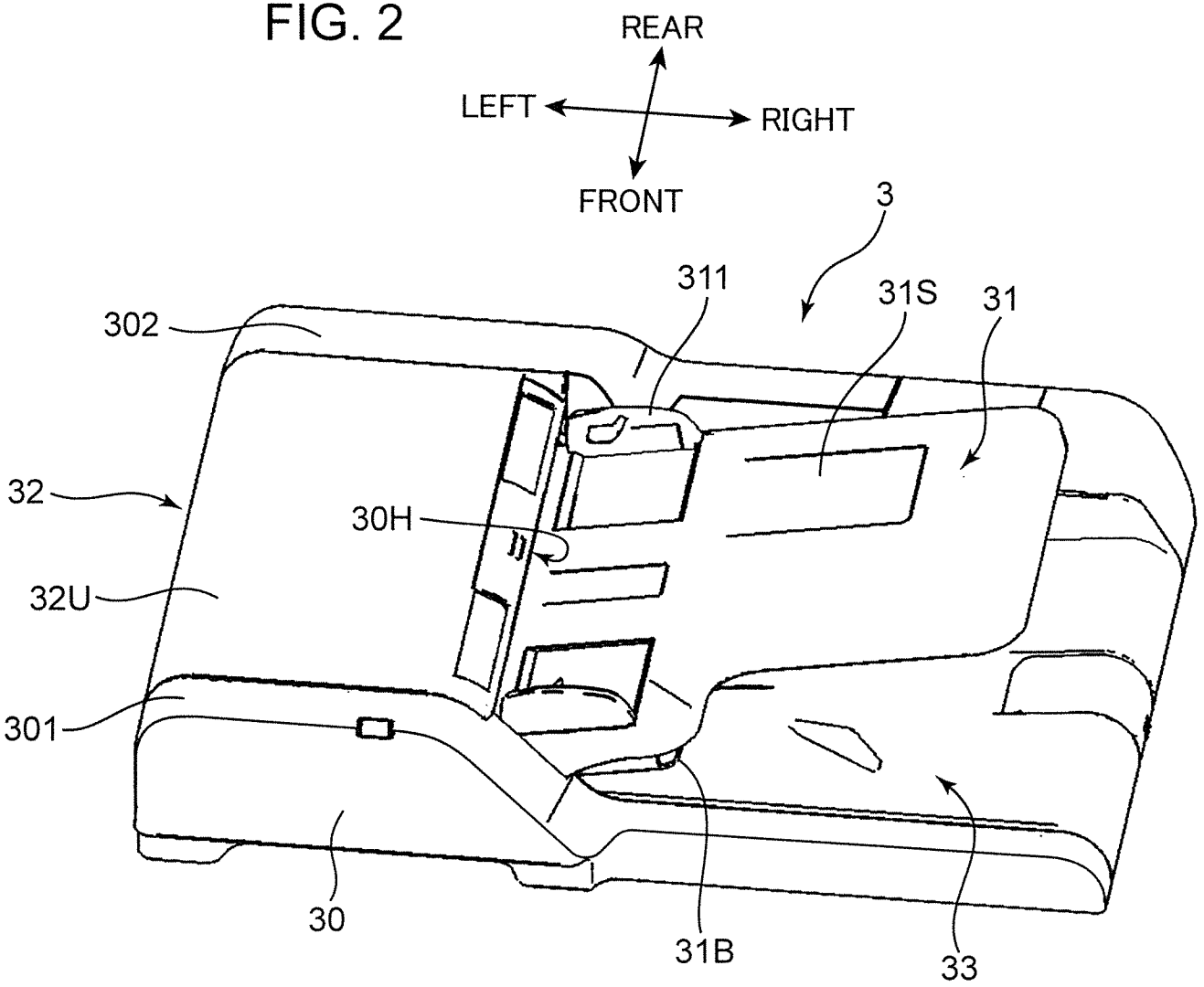
FIG. 2 is a perspective view of an automatic document feeder according to an embodiment of the present invention.
Figure 3:
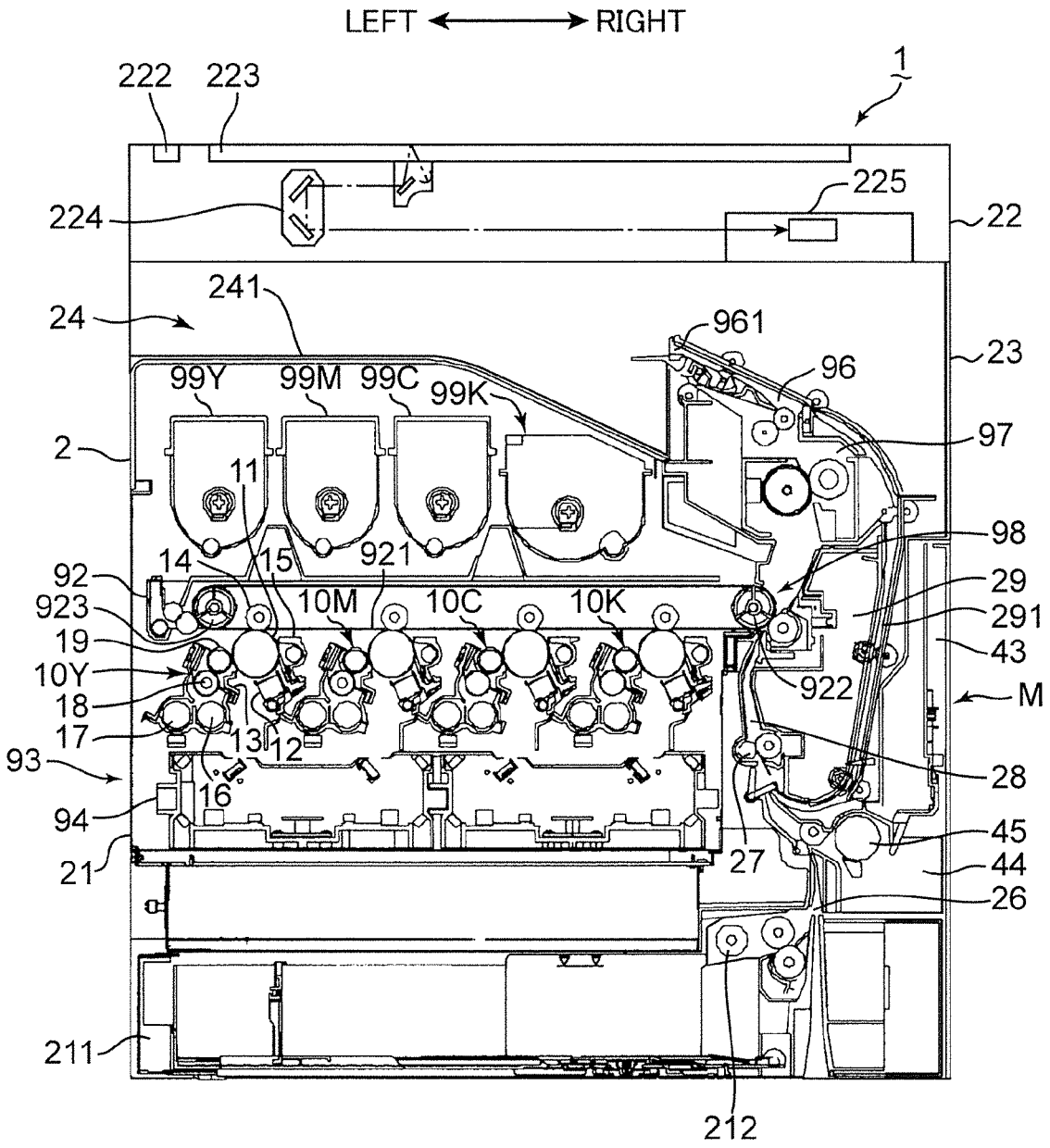
FIG. 3 is a sectional view showing an internal structure of an image forming device according to an embodiment of the present invention.

Hereinafter, an embodiment of the present invention will be described in detail with reference to the drawings. FIG. 1 is a perspective view showing an external appearance of an image forming device 1 according to an embodiment of the present invention, FIG. 2 is a perspective view showing an external appearance of an automatic document feeder 3, and FIG. 3 is a sectional view showing an internal structure of the image forming device 1. While an in-body paper discharge type copier is exemplified herein as the image forming device 1, alternatively, the image forming device 1 may be a printer, a facsimile device, or a multifunction machine including functions of these devices.

The image forming device 1 includes a device main body 2 which has a case structure with an approximately rectangular parallelepiped shape and which has an in-body space (an in-body paper discharge section 24), the automatic document feeder 3 (a sheet feeder) arranged on an upper surface of the device main body 2, and an extension paper feed unit 4 assembled onto a lower side of the device main body 2.

The device main body 2 performs an image forming process on a sheet. The device main body 2 includes a lower case 21 with an approximately rectangular parallelepiped shape, an upper case 22 which has an approximately rectangular parallelepiped shape and which is arranged above the lower case 21, and a connecting case 23 which connects the lower case 21 and the upper case 22 to each other. Various devices for image formation are housed in the lower case 21, and various devices for optically reading a document image are housed in the upper case 22. The in-body space enclosed by the lower case 21, the upper case 22, and the connecting case 23 constitutes the in-body paper discharge section 24 capable of housing a sheet after image formation. The connecting case 23 is arranged on a side of a right side surface of the device main body 2 and is provided with a discharge port 961 for discharging a sheet to the in-body paper discharge section 24.

The in-body space that is used as the in-body paper discharge section 24 is opened to the outside on a front surface and a left side surface of the device main body 2. A user can reach into the in-body paper discharge section 24 from these opened portions and pull out a sheet after image formation from the in-body paper discharge section 24. A bottom surface 241 of the in-body space is defined by an upper surface of the lower case 21 and sheets discharged from the discharge port 961 (FIG. 3) are stacked on the bottom surface 241.

An operation panel unit 25 is provided on a front surface of the upper case 22 so as to protrude from the front surface. The operation panel unit 25 is provided with operation keys 251 including numeric keys and a start key, an LCD touch panel 252, and the like, and accepts input of various operation instructions from the user. The user can input the number of sheets to be printed, printing density, and the like through the operation panel unit 25.

A paper feed cassette 211 that houses recording sheets on which an image forming process is to be performed is mounted to the lower case 21. The extension paper feed unit 4 also includes paper feed cassettes 41 and 42 that house recording sheets on which an image forming process is to be performed. The paper feed cassettes 211, 41, and 42 are cassettes provided for automatic paper feeding and are capable of housing a large number of recording sheets by size. In addition, the paper feed cassettes 211, 41, and 42 can be pulled out to the front from a front surface of the lower case 21 or the extension paper feed unit 4. Note that only the paper feed cassette 211 of the lower case 21 is depicted in FIG. 3.

A multi-tray unit M that enables the user to perform manual paper feeding is mounted to a right side surface of the device main body 2. Referring to FIG. 3, the multi-tray unit M includes a paper feed tray 43 on which a manually-fed recording sheet is placed and a paper feed unit 44 which delivers the recording sheet to an image forming section in the lower case 21. The paper feed tray 43 is attached at a lower end section thereof so as to be openable and closable with respect to the lower case 21 and is set to a closed state when not in use. When performing manual paper feeding, the user opens the paper feed tray 43 and places a recording sheet thereon.

The automatic document feeder 3 is rotatably attached to an upper surface of the device main body 2 on a rear side of the automatic document feeder 3. Note that the automatic document feeder 3 has been omitted in FIG. 3. The automatic document feeder 3 automatically feeds a document sheet to be copied toward a predetermined document reading position (a position onto which a first contact glass 222 is assembled) in the device main body 2. Meanwhile, when the user manually places a document sheet at a predetermined document reading position (an arrangement position of a second contact glass 223), the automatic document feeder 3 is opened upward.

Referring to FIG. 2, the automatic document feeder 3 includes a main body housing 30 (a case), a document feed tray 31 (a tray), a document conveyance section 32, a document discharge tray 33, and a document reversal tray 31B. The main body housing 30 is a case that houses various mechanisms provided in the automatic document feeder 3. The main body housing 30 includes a front wall section 301 and a rear wall section 302 which are raised upward at a left side portion that houses the document conveyance section 32, and has an approximately flat low level portion in a right side portion.

The document feed tray 31 is a tray on which a document sheet to be fed to the image reading position is placed. The document feed tray 31 has a placement surface 31S with an upper surface on which the sheet is placed. The document feed tray 31 is arranged in the main body housing 30 so as to extend from a feed port 30H of the main body housing 30. A pair of cursors 311 for aligning a width of a placed document sheet is provided in the document feed tray 31. The cursors 311 are configured to be slidable in a sheet width direction via a pinion gear and a rack (both not shown).

The document conveyance section 32 includes a conveyance path and a paper feed mechanism which convey a document sheet on the document feed tray 31 to the document discharge tray 33 via the image reading position. The document conveyance section 32 includes an upper cover unit 32U that is fitted into an opening between the front wall section 301 and the rear wall section 302 of the main body housing 30. The cover unit 32U is openable and closable with respect to the main body housing 30.

The document discharge tray 33 is a tray to which a document sheet after a document image has been optically read therefrom is discharged. An upper surface of the low level portion described above on the right side of the main body housing 30 constitutes the document discharge tray 33. The document reversal tray 31B is a tray to which a document sheet having document images on both surfaces thereof is temporarily discharged when reading the document sheet.

Next, an internal structure of the device main body 2 will be explained with reference to FIG. 3. Toner containers 99Y, 99M, 99C, and 99K, an intermediate transfer unit 92, an image forming section 93, an exposure unit 94, and the paper feed cassette 211 described earlier are housed inside the lower case 21 in this order from top to bottom.

The image forming section 93 includes four image forming units 10Y, 10M, 10C, and 10K which form respective toner images of yellow (Y), magenta (M), cyan (C), and black (K) in order to form a full-color toner image. The respective image forming units 10Y, 10M, 10C, and 10K include a photoreceptor drum 11 as well as a charger 12, a developing device 13, a primary transfer roller 14, and a cleaning device 15 arranged in a periphery of the photoreceptor drum 11.

The photoreceptor drum 11 rotates around an axis thereof, and an electrostatic latent image and a toner image are formed on a peripheral surface thereof. As the photoreceptor drum 11, a photoreceptor drum using an amorphous silicon (a-Si) based material can be used. The charger 12 uniformly charges a surface of the photoreceptor drum 11. The charged peripheral surface of the photoreceptor drum 11 is exposed by the exposure unit 94 and an electrostatic latent image is formed thereon.

In order to develop an electrostatic latent image formed on the photoreceptor drum 11, the developing device 13 supplies toner to the peripheral surface of the photoreceptor drum 11. The developing device 13 is a developing device for a two-component developer and includes stirring rollers 16 and 17, a magnetic roller 18, and a developing roller 19. The stirring rollers 16 and 17 charge the toner by stirring and circulatively conveying the two-component developer. A peripheral surface of the magnetic roller 18 bears a two-component developer layer, and a peripheral surface of the developing roller 19 bears a toner layer formed by delivery of toner due to a difference in potentials between the magnetic roller 18 and the developing roller 19. The toner on the developing roller 19 is supplied to the peripheral surface of the photoreceptor drum 11 and the electrostatic latent image is developed.

The primary transfer roller 14 forms a nip section together with the photoreceptor drum 11 across an intermediate transfer belt 921 provided in the intermediate transfer unit 92 and primarily transfers a toner image on the photoreceptor drum 11 onto the intermediate transfer belt 921. The cleaning device 15 cleans the peripheral surface of the photoreceptor drum 11 after transfer of the toner image.

The yellow toner container 99Y, the magenta toner container 99M, the cyan toner container 99C, and the black toner container 99K are for respectively storing a toner of each color and supplying the toner of each color to the developing device 13 of the image forming units 10Y, 10M, 10C, and 10K corresponding to each of the colors YMCK through a supply route (not shown).

The exposure unit 94 includes various optical system devices such as a light source, a polygon mirror, a reflection mirror, a deflection mirror, and the like, and irradiates light based on image data of a document image on the peripheral surface of the photoreceptor drum 11 provided in each of the image forming units 10Y, 10M, 10C, and 10K to form an electrostatic latent image.

The intermediate transfer unit 92 includes the intermediate transfer belt 921, a driving roller 922, and a driven roller 923. Toner images from the plurality of photoreceptor drums 11 are drawn on the intermediate transfer belt 921 so as to overlap each other (primary transfer). The toner images drawn so as to overlap each other are secondarily transferred at a secondary transfer section 98 onto a recording sheet supplied from the paper feed cassette 211. The driving roller 922 and the driven roller 923 which circulatively drive the intermediate transfer belt 921 are rotatably supported by the lower case 21.

The paper feed cassette 211 (41, 42) houses a sheet bundle constituted by a stack of a plurality of recording sheets. A pickup roller 212 is arranged in an upper part of a right end side of the paper feed cassette 211. Due to driving of the pickup roller 212, recording sheets in an uppermost layer of the sheet bundle in the paper feed cassette 211 are fed out one sheet at a time and delivered to a delivery conveyance path 26. Meanwhile, a manually-fed recording sheet placed on the paper feed tray 43 is delivered to the delivery conveyance path 26 by driving of a paper feed roller 45 of the paper feed unit 44.

A sheet conveyance path 28 that extends to the discharge port 961 via the secondary transfer section 98, a fixing unit 97 and a paper discharge unit 96 (to be described later) is provided on a downstream side of the delivery conveyance path 26. An upstream portion of the sheet conveyance path 28 is formed between an inner wall formed in the lower case 21 and an inner wall that forms an inner side surface of a reverse transfer unit 29. Moreover, an outer side surface of the reverse transfer unit 29 constitutes one surface of a reverse conveyance path 291 that reversely conveys a sheet during duplex printing. A pair of resist rollers 27 is arranged on an upstream side of the secondary transfer section 98 on the sheet conveyance path 28. A sheet is temporarily stopped by the pair of resist rollers 27 to undergo skew correction and is subsequently fed out to the secondary transfer section 98 at a predetermined timing for image transfer.

The fixing unit 97 and the paper discharge unit 96 are housed inside the connecting case 23. The fixing unit 97 includes a fixing roller and a pressure roller and performs a fixing process by applying heat and pressure to a recording sheet on which a toner image has been secondarily transferred at the secondary transfer section 98. A recording sheet with a color image after the fixing process is discharged from the discharge port 961 toward the in-body paper discharge section 24 by the paper discharge unit 96 arranged on a downstream side of the fixing unit 97.

The first contact glass 222 and the second contact glass 223 are fitted into an upper surface of the upper case 22. The first contact glass 222 is provided for reading a document sheet that is automatically fed from the automatic document feeder 3. The second contact glass 223 is provided for reading a manually-placed document sheet.

A scanning mechanism 224 and an imaging element 225 for optically reading document information of a document sheet are housed inside the upper case 22 (an image reading section). The scanning mechanism 224 includes a light source, a moving carriage, a reflection mirror, and the like and guides reflected light from a document to the imaging element 225. The imaging element 225 photoelectrically converts the reflected light into an analog electrical signal. The analog electrical signal is converted into a digital electrical signal by an A/D conversion circuit (not shown) and subsequently input to the exposure unit 94.

Figure 4:
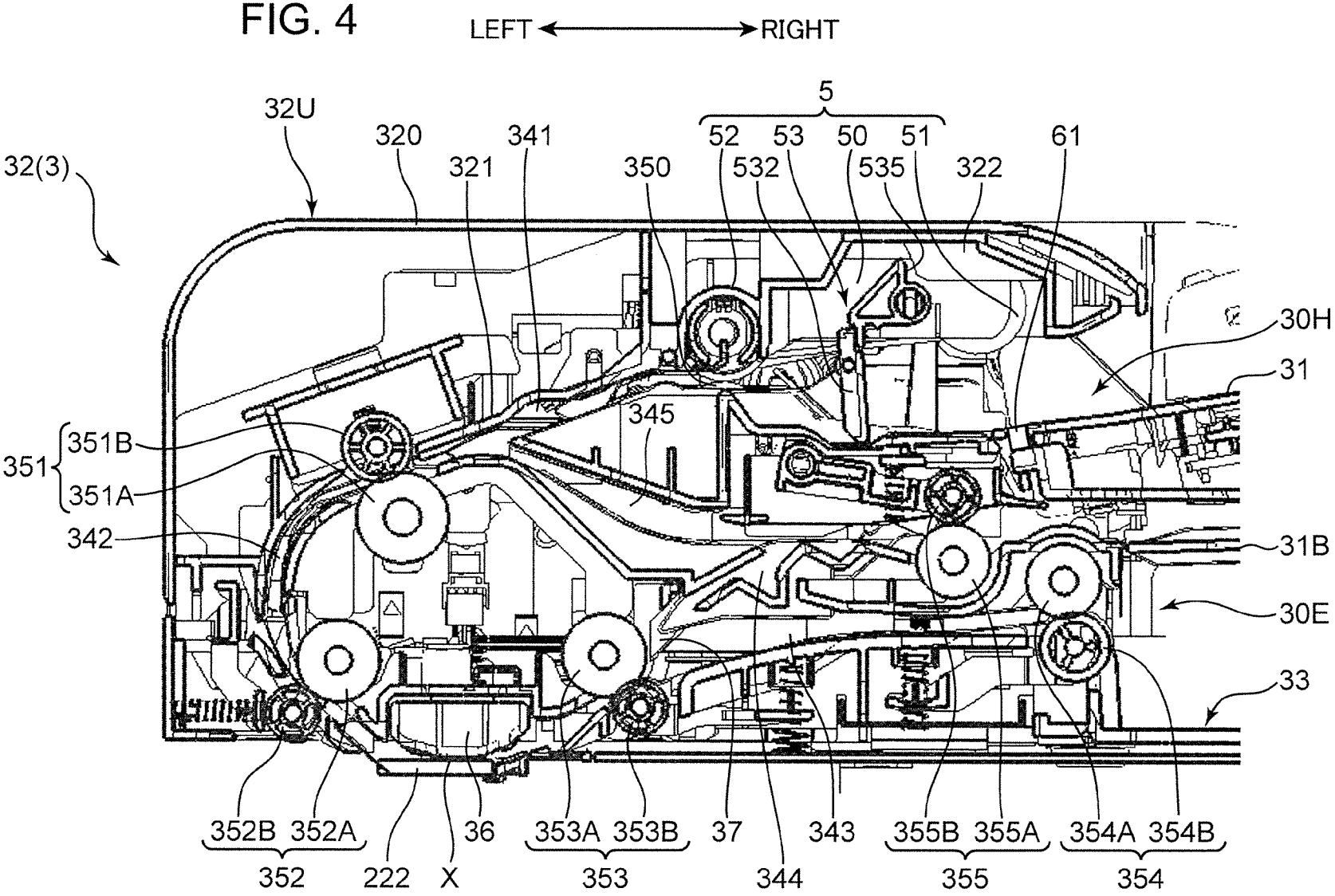
FIG. 4 is a sectional view of a document conveyance section that is a substantial part of an automatic document feeder according to an embodiment of the present invention.
Figure 5:
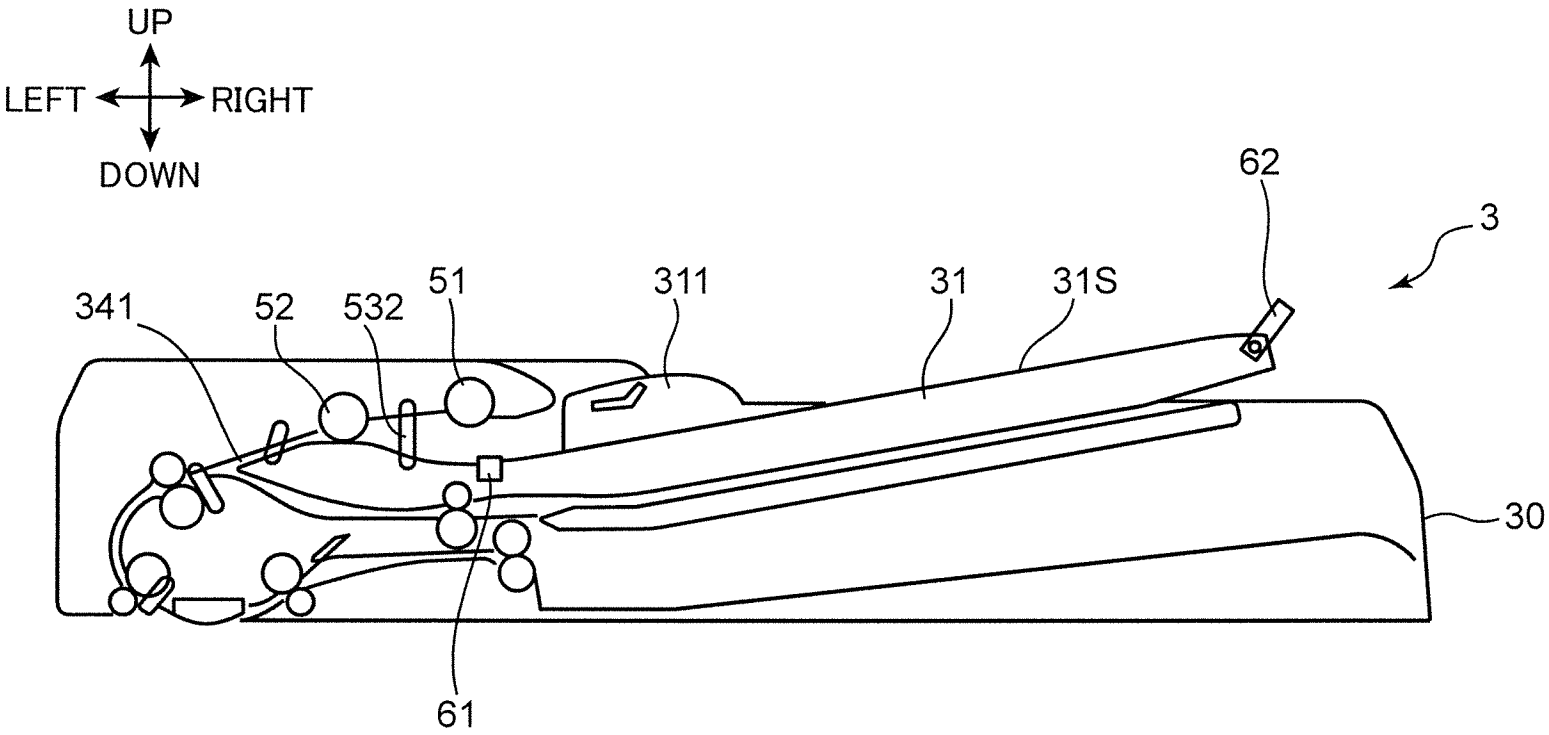
FIG. 5 is a schematic sectional view of an automatic document feeder according to an embodiment of the present invention.

Next, an internal structure of the automatic document feeder 3 will be described in detail with reference to FIG. 4. FIG. 4 is a sectional view of a substantial part (the document conveyance section 32) of the automatic document feeder 3. In addition, FIG. 5 is a schematic sectional view of the automatic document feeder 3. The document conveyance section 32 includes first to fifth conveyance paths 341 to 345 which constitute conveyance routes of a document sheet, first to fifth pairs of conveyance rollers 351 to 355 arranged at appropriate locations on the first to fifth conveyance paths 341 to 345, and a document feed unit 5 that feeds a document sheet placed on the document feed tray 31 into the document conveyance section 32.

The first, second and third conveyance paths 341, 342, and 343 extend from the document feed tray 31. Specifically, the first, second and third conveyance paths 341, 342, and 343 constitute a conveyance path which is curved in a U-shape and which extends from the feed port 30H of the main body housing 30 via an optical reading position X of a document image to a discharge port 30E from which a document sheet is discharged to the document discharge tray 33. A document sheet is conveyed along the first, second and third conveyance paths 341, 342, and 343 in a predetermined conveyance direction. On the other hand, the fourth and fifth conveyance paths 344 and 345 are switchback conveyance paths that are used to reverse a document sheet having document images on both surfaces thereof when reading the document sheet.

The first conveyance path 341 (a sheet conveyance path) is a conveyance path which is connected with the document feed tray 31 and which extends leftward from the feed port 30H so as to be slightly lowered at a tip thereof. The first conveyance path 341 is a conveyance path which a document sheet fed out from the document feed unit 5 passes through first. An upper side conveyance surface of the first conveyance path 341 is defined by a guide member 321 of the upper cover unit 32U. The second conveyance path 342 is an arc-shaped conveyance path which extends from a downstream end of the first conveyance path 341 to a position opposing the first contact glass 222 which is a document reading position X. One conveyance surface of the second conveyance path 342 is also defined by the guide member 321 of the upper cover unit 32U. The third conveyance path 343 is a conveyance path which extends rightward from the position opposing the first contact glass 222 to the discharge port 30E so as to be slightly raised at a tip thereof. Moreover, a surface contact guide 36 that causes a document sheet to come into sliding contact with the first contact glass 222 is arranged at the position opposing the first contact glass 222.

The fourth conveyance path 344 is a conveyance path which branches from the third conveyance path 343 and which extends upward and to the right. A sorting lever 37 is arranged at a branching part of the third conveyance path 343 and the fourth conveyance path 344. While the sorting lever 37 guides a document sheet to the third conveyance path 343 in a case of normal single-side reading, the sorting lever 37 guides a document sheet to the fourth conveyance path 344 when front and rear of the document sheet after single-side reading must be reversed in a case where double-side reading of the document sheet is executed. The fifth conveyance path 345 is an approximately horizontal conveyance path communicated with the fourth conveyance path 344, the first conveyance path 341, and the document reversal tray 31B. The fifth conveyance path 345 is a conveyance path for receiving a document sheet of which front and rear are to be reversed from the fourth conveyance path 344 and performing switchback conveyance of the document sheet to the first conveyance path 341.

The first, second, third, fourth, and fifth pairs of conveyance rollers 351, 352, 353, 354, and 355 are respectively constituted by combinations of driving rollers 351A, 352A, 353A, 354A, and 355A which generate a rotational drive force for conveying a document sheet and driven rollers 351B, 352B, 353B, 354B, and 355B which are abutted and rotationally driven by the driving rollers 351A, 352A, 353A, 354A, and 355A.

The first pair of conveyance rollers 351 is arranged between the first conveyance path 341 and the second conveyance path 342 and feeds a document sheet toward the second conveyance path 342 that is greatly curved. The second pair of conveyance rollers 352 is arranged immediately upstream with respect to the document reading position X and feeds a document sheet to the document reading position X. The third pair of conveyance rollers 353 is arranged immediately downstream with respect to the document reading position X and feeds out a document sheet after image reading to the third conveyance path 343 or the fourth conveyance path 344. The fourth pair of conveyance rollers 354 is arranged in a vicinity of the discharge port 30E and discharges a document sheet toward the document discharge tray 33. The fifth pair of conveyance rollers 355 is a pair of rollers which is capable of forward rotation and reserve rotation and which is arranged on the fifth conveyance path 345, and executes switchback conveyance of a document sheet using the document reversal tray 31B.

The document feed unit 5 includes a pickup roller 51, a document feed roller 52 (a paper feed member) arranged on a downstream side in the sheet conveyance direction with respect to the pickup roller 51, a stopper mechanism 53 which restricts a document sheet placed on the document feed tray 31, and a holder 50 which holds these members. The document feed unit 5 is assembled onto the upper cover unit 32U.

The holder 50 supports the pickup roller 51 and the document feed roller 52. The holder 50 is configured to be rotatable with an axis of rotation of the document feed roller 52 as a rotation fulcrum. In this case, the holder 50 is configured to be rotatable in a forward direction (clockwise) and in a reverse direction (counterclockwise).

The pickup roller 51 receives a rotational force causing the pickup roller 51 to rotate around its axis and feeds out document sheets placed on the document feed tray 31 toward the document conveyance section 32 (the first conveyance path 341) one sheet at a time. Due to rotation of the holder 50, the pickup roller 51 changes positions between a paper feed position that is in contact with an upper surface of a document sheet on the document feed tray 31 and a retreat position that is separated upward from the upper surface of a document sheet.

The document feed roller 52 is arranged on an entrance side of the first conveyance path 341. The document feed roller 52 further conveys a single document sheet fed out from the pickup roller 51 in the conveyance direction toward the first conveyance path 341.

The stopper mechanism 53 is positioned between the pickup roller 51 and the document feed roller 52 in a horizontal direction. The stopper mechanism 53 is configured to restrict a leading end of a document sheet in a paper feeding direction before the pickup roller 51 starts a paper feed operation and aligns the leading end in the paper feeding direction. By aligning the leading end in the paper feeding direction, a document sheet can be prevented from being fed into the first conveyance path 341 in a skewed posture. The stopper mechanism 53 includes a stopper piece 532 (a restricting member) and an abutting piece 535. In addition, the automatic document feeder 3 includes a restricting section 322 provided so as to protrude downward from a top plate 320 of the upper cover unit 32U.

When the holder 50 is rotated in the forward direction and the pickup roller 51 is arranged at the paper feed position, the abutting piece 535 of the stopper mechanism 53 is separated from the restricting section 322. As a result, the stopper mechanism 53 becomes rotatable. The stopper mechanism 53 rotates as a leading end section of a sheet fed out by the pickup roller 51 abuts the stopper mechanism 53. Consequently, the stopper piece 532 separates from the first conveyance path 341 in an upward direction (separated position). On the other hand, when the holder 50 is rotated in the reverse direction and the pickup roller 51 is arranged at the retreat position, the abutting piece 535 of the stopper mechanism 53 abuts the restricting section 322 due to a biasing force of a biasing spring (not shown) arranged in advance. As a result, the stopper mechanism 53 is rotated and the stopper piece 532 protrudes to the first conveyance path 341 (protruded position).

Furthermore, the automatic document feeder 3 includes a leading end detection switch 61 (a first detection section) and a trailing end detection switch 62 (a second detection section) (FIG. 5). The leading end detection switch 61 detects a leading end side in the conveyance direction of a document sheet placed on the placement surface 31S of the document feed tray 31. The leading end detection switch 61 is a light-reflecting sensor which emits detection light to a document sheet and which receives detection light reflected by the document sheet. The trailing end detection switch 62 is arranged at an end section on a trailing end side in the conveyance direction of the document feed tray 31 and detects a trailing end side in the conveyance direction of a document sheet placed on the placement surface 31S. Due to the leading end detection switch 61 and the trailing end detection switch 62, a size of a document sheet in the conveyance direction is detected. Moreover, a size of a document sheet in a sheet width direction that is perpendicular to the conveyance direction is detected by a width detection mechanism (not shown) in accordance with a position of the cursors 311 that are slidingly moved. A structure of the trailing end detection switch 62 and functions of the leading end detection switch 61 and the trailing end detection switch 62 will be described in detail later.

Figure 13:
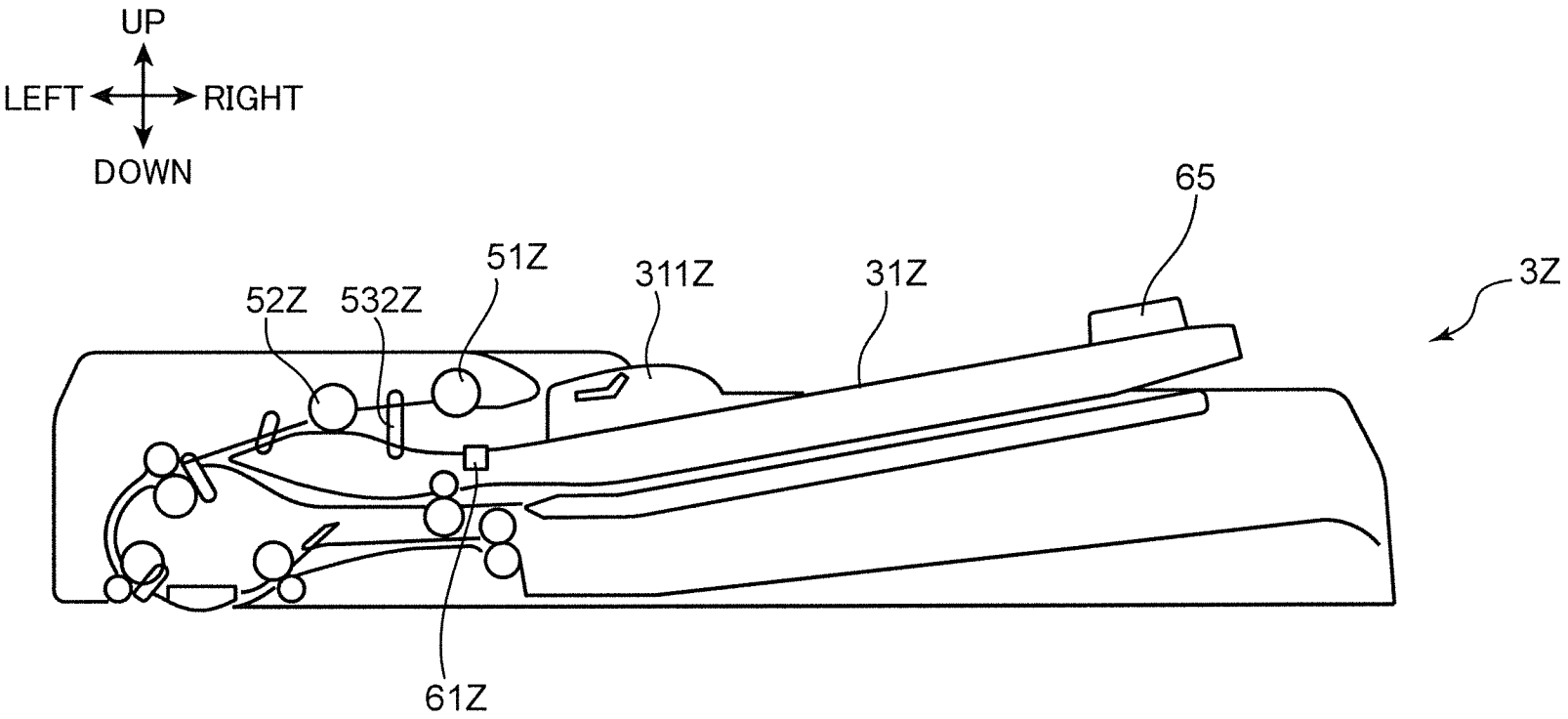
FIG. 13 is a schematic sectional view of another automatic document feeder to be compared with an automatic document feeder according to an embodiment of the present invention.
Figure 14:
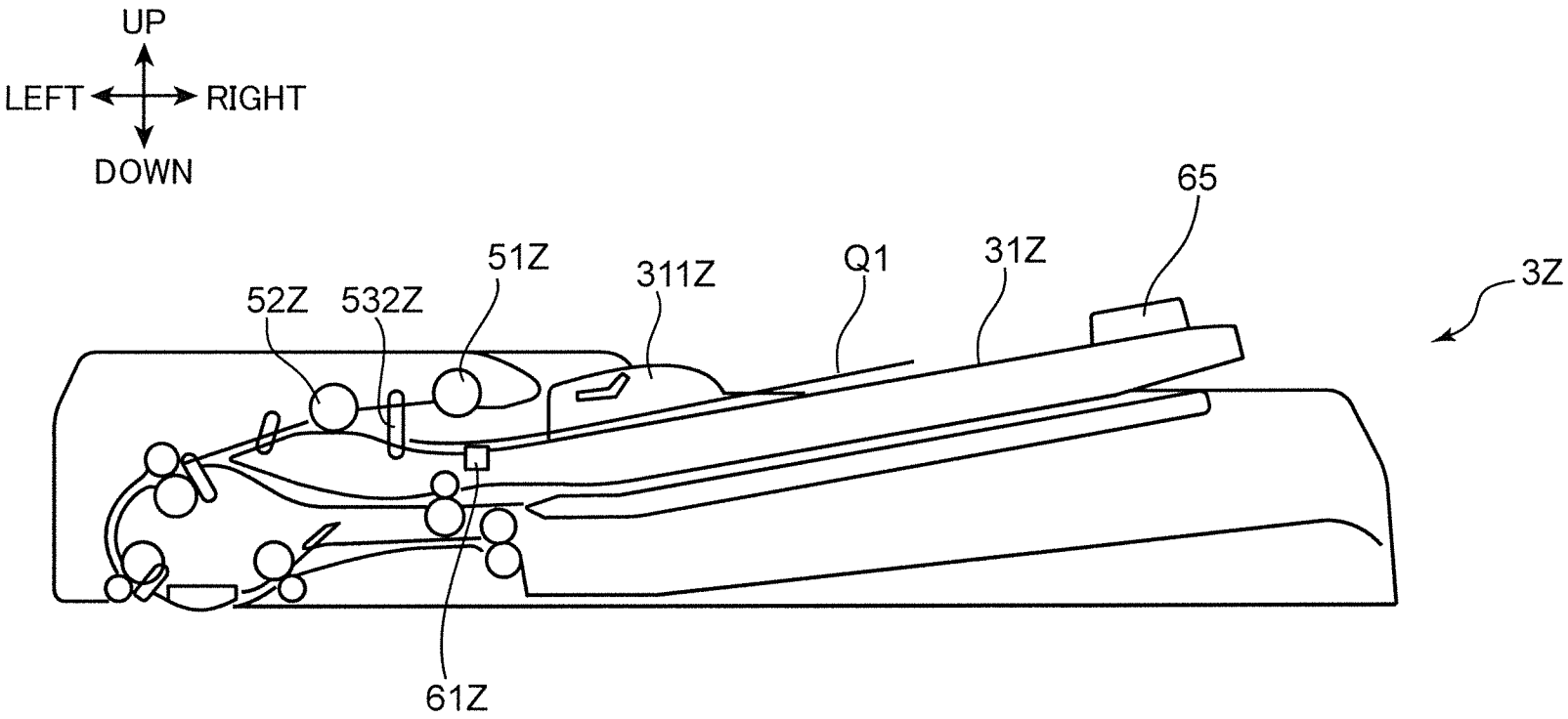
FIG. 14 is a schematic sectional view showing a state where a sheet with a first length is placed on a tray of another automatic document feeder to be compared with an automatic document feeder according to an embodiment of the present invention.
Figure 15:
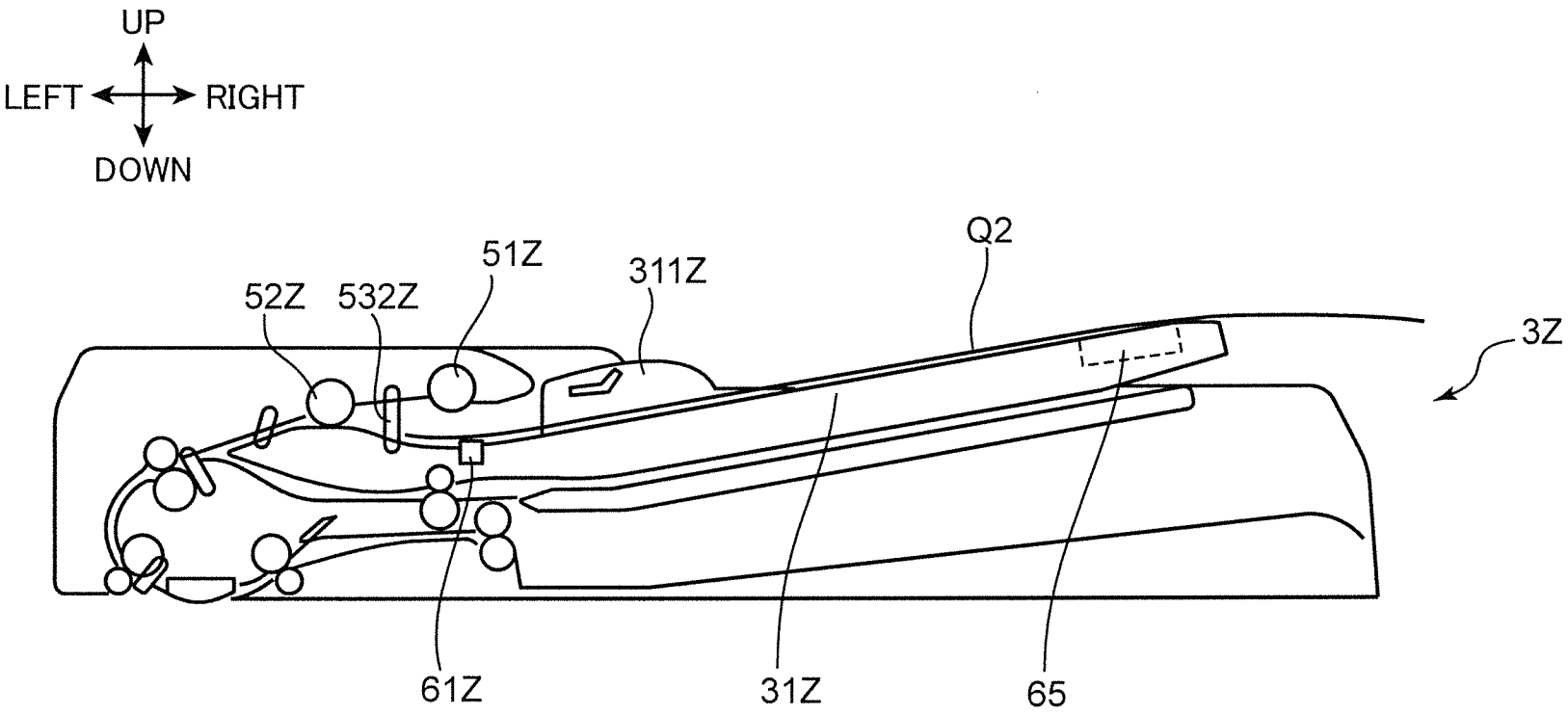
FIG. 15 is a schematic sectional view showing a state where a sheet with a second length is placed on a tray of another automatic document feeder to be compared with an automatic document feeder according to an embodiment of the present invention.
Figure 16:
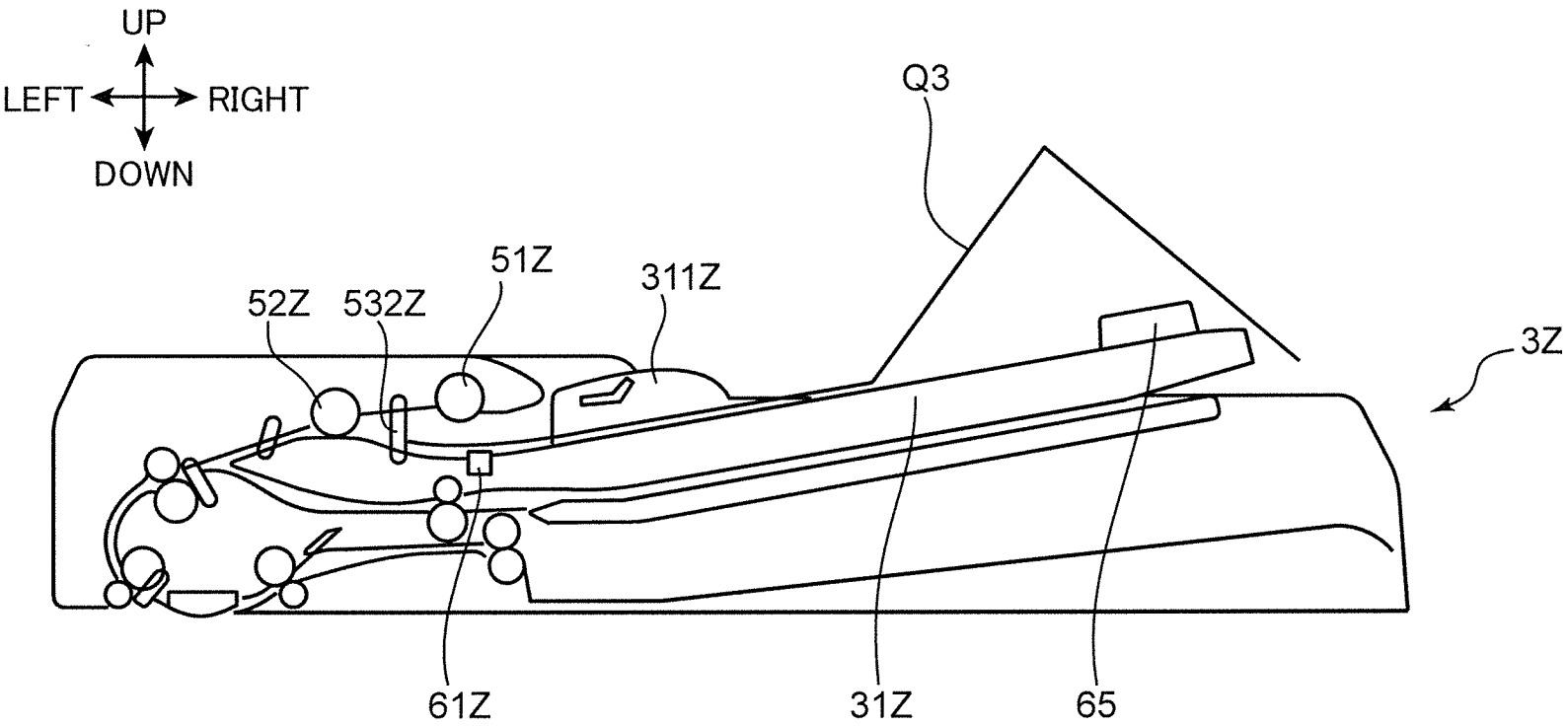
FIG. 16 is a schematic sectional view showing a situation where a partially-bent sheet with a second length is placed on a tray of another automatic document feeder to be compared with an automatic document feeder according to an embodiment of the present invention.

Next, a problem in another automatic document feeder 3Z to be compared with the automatic document feeder 3 according to the present embodiment will be described. FIG. 13 is a schematic sectional view of the automatic document feeder 3Z. FIG. 14 is a schematic sectional view showing a state where a sheet Q1 with a first length is placed on a document feed tray 31Z of the automatic document feeder 3Z. FIG. 15 is a schematic sectional view showing a state where a sheet Q2 with a second length is placed on the document feed tray 31Z of the automatic document feeder 3Z. FIG. 16 is a schematic sectional view showing a state where a partially-bent sheet Q3 with the second length is placed on the document feed tray 31Z of the automatic document feeder 3Z.

The automatic document feeder 3Z includes a leading end detection switch 61Z and a trailing end detection piece 65. The leading end detection switch 61Z detects a leading end side in the conveyance direction of a document sheet placed on a placement surface of the document feed tray 31Z in a similar manner to the leading end detection switch 61 according to the present embodiment. The leading end detection switch 61Z is a light-reflecting sensor which emits detection light to a document sheet and which receives detection light reflected by the document sheet. The trailing end detection piece 65 detects a trailing end side in the conveyance direction of a document sheet placed on the placement surface of the document feed tray 31Z. Moreover, the trailing end detection piece 65 is arranged at a position that is offset to a leading end side with respect to an end section on the trailing end side in the conveyance direction of the document feed tray 31Z. The trailing end detection piece 65 protrudes upward from the placement surface of the document feed tray 31Z and is depressed below the placement surface by being pressed by a document sheet placed on the document feed tray 31Z. Due to detection of the depressed trailing end detection piece 65 by a photointerrupter (not shown), a trailing end side of a document sheet placed on the document feed tray 31Z is detected.

Referring to FIG. 14, the sheet Q1 with a first length is placed on the document feed tray 31Z. For example, the sheet Q1 is an A4 size document sheet. The sheet Q1 is placed on the document feed tray 31Z so that a longitudinal portion is aligned in a sheet width direction (front-rear direction). At this point, the leading end detection switch 61Z detects a leading end section in the conveyance direction of the sheet Q1. Meanwhile, as shown in FIG. 14, a trailing end section in the conveyance direction of the sheet Q1 is positioned on a leading end side in the conveyance direction with respect to the trailing end detection piece 65. Therefore, the sheet Q1 does not press the trailing end detection piece 65 downward. As a result, a control section (not shown) detects that the sheet Q1 is placed on the document feed tray 31Z based on an ON signal output from the leading end detection switch 61Z and an OFF signal output from the trailing end detection piece 65.

Meanwhile, referring to FIG. 15, the sheet Q2 with a second length that is longer than the first length is placed on the document feed tray 31Z. For example, the sheet Q2 is an A3 size document sheet. The sheet Q2 is placed on the document feed tray 31Z so that a longitudinal portion is aligned in a conveyance direction (left-right direction). At this point, the leading end detection switch 61Z detects a leading end section in the conveyance direction of the sheet Q2. In addition, as shown in FIG. 15, the trailing end detection piece 65 is pressed downward by the sheet Q2 and a trailing end side in the conveyance direction of the sheet Q2 is detected. As a result, the control section (not shown) detects that the sheet Q2 is placed on the document feed tray 31Z based on an ON signal output from the leading end detection switch 61Z and an ON signal output from the trailing end detection piece 65.

Furthermore, with reference to FIG. 16, the sheet Q3 which has the second length and which is partially bent on a trailing end side is placed on the document feed tray 31Z. An example of such a state is a case where the sheet Q3 has been Z-folded in advance. When the A3 size sheet Q3 is bound together with the A4 size sheet Q1, the A3 size sheet Q3 may be Z-folded in this manner. With a Z-fold, the A-size sheet Q3 is mountain-folded at a center portion in a longitudinal direction and, subsequently, a half region in the longitudinal direction (the trailing end side) is folded back and mountain-folded. When the A3 size sheet Q3 that has been Z-folded in this manner is placed on the document feed tray 31Z, since a crease made by the Z-fold remains, a trailing end side of the sheet Q3 in the conveyance direction is bent in a mountain shape as shown in FIG. 16.

In addition, in this case, the leading end detection switch 61Z detects a leading end section in the conveyance direction of the sheet Q3 as shown in FIG. 16. On the other hand, since the trailing end section of the sheet Q3 that is bent in a mountain shape cannot press the trailing end detection piece 65 downward, the trailing end detection piece 65 remains protruding from the document feed tray 31Z. As a result, the control section (not shown) erroneously detects that the sheet Q1 is placed on the document feed tray 31Z based on an ON signal output from the leading end detection switch 61Z and an OFF signal output from the trailing end detection piece 65. Moreover, a light-reflecting sensor may be adopted as the trailing end detection piece 65 in a similar manner to the leading end detection switch 61. However, in this case, a detectable distance of the trailing end detection piece 65 must be set long and, as a result, cost related to the trailing end detection piece 65 increases.

Figure 6:
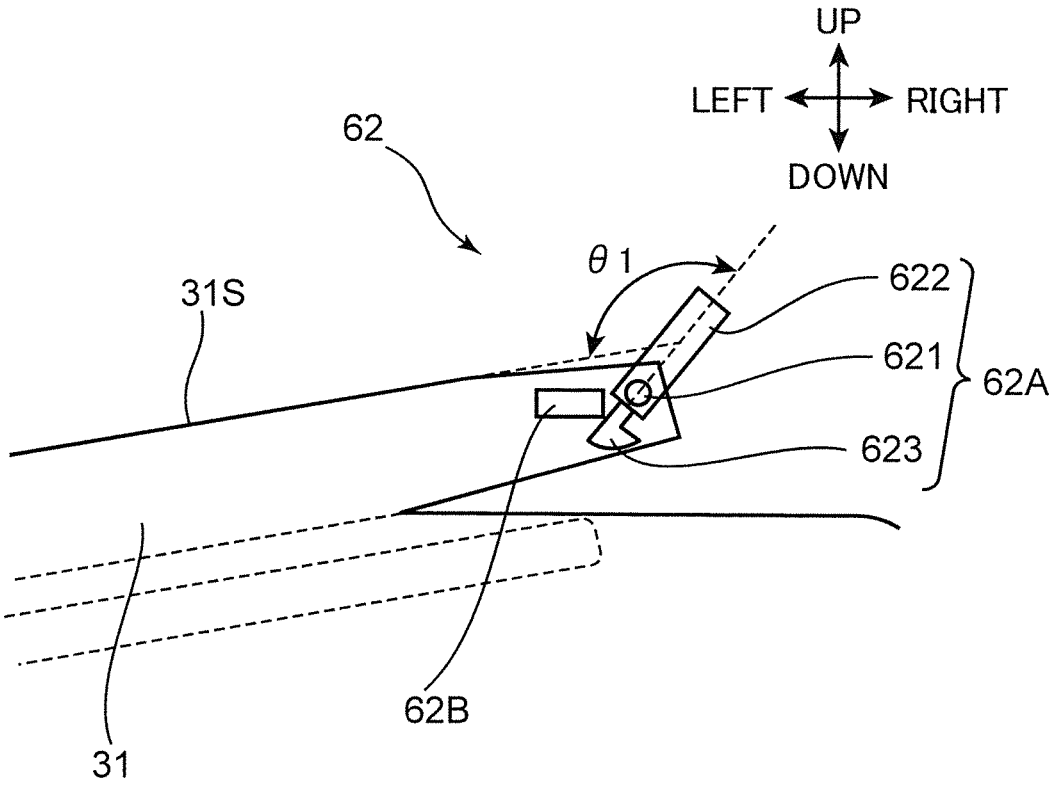
FIG. 6 is a schematic sectional view for explaining a structure of a second detection section according to an embodiment of the present invention.
Figure 7:
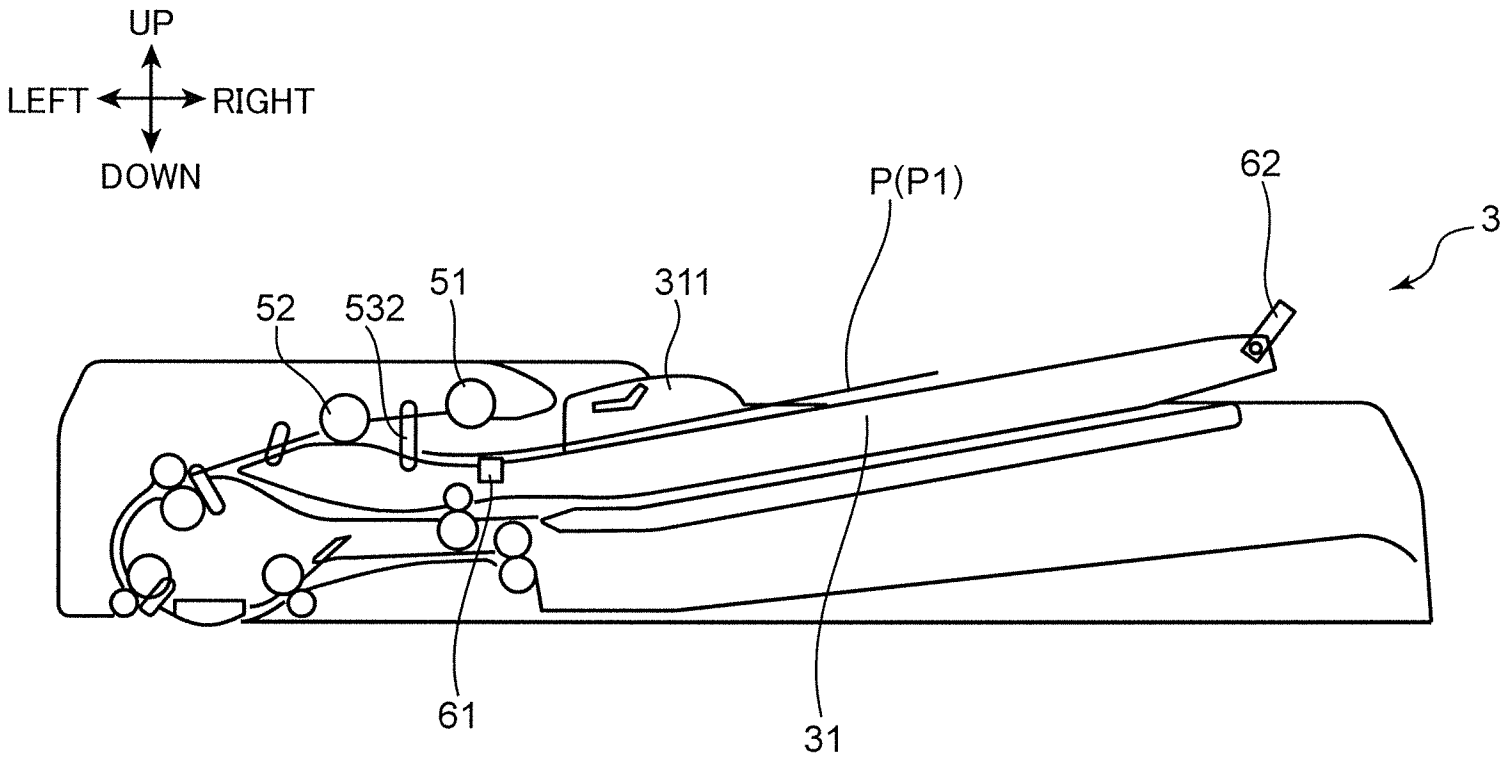
FIG. 7 is a schematic sectional view showing a state where a sheet with a first length is placed on a tray of an automatic document feeder according to an embodiment of the present invention.
Figure 8:
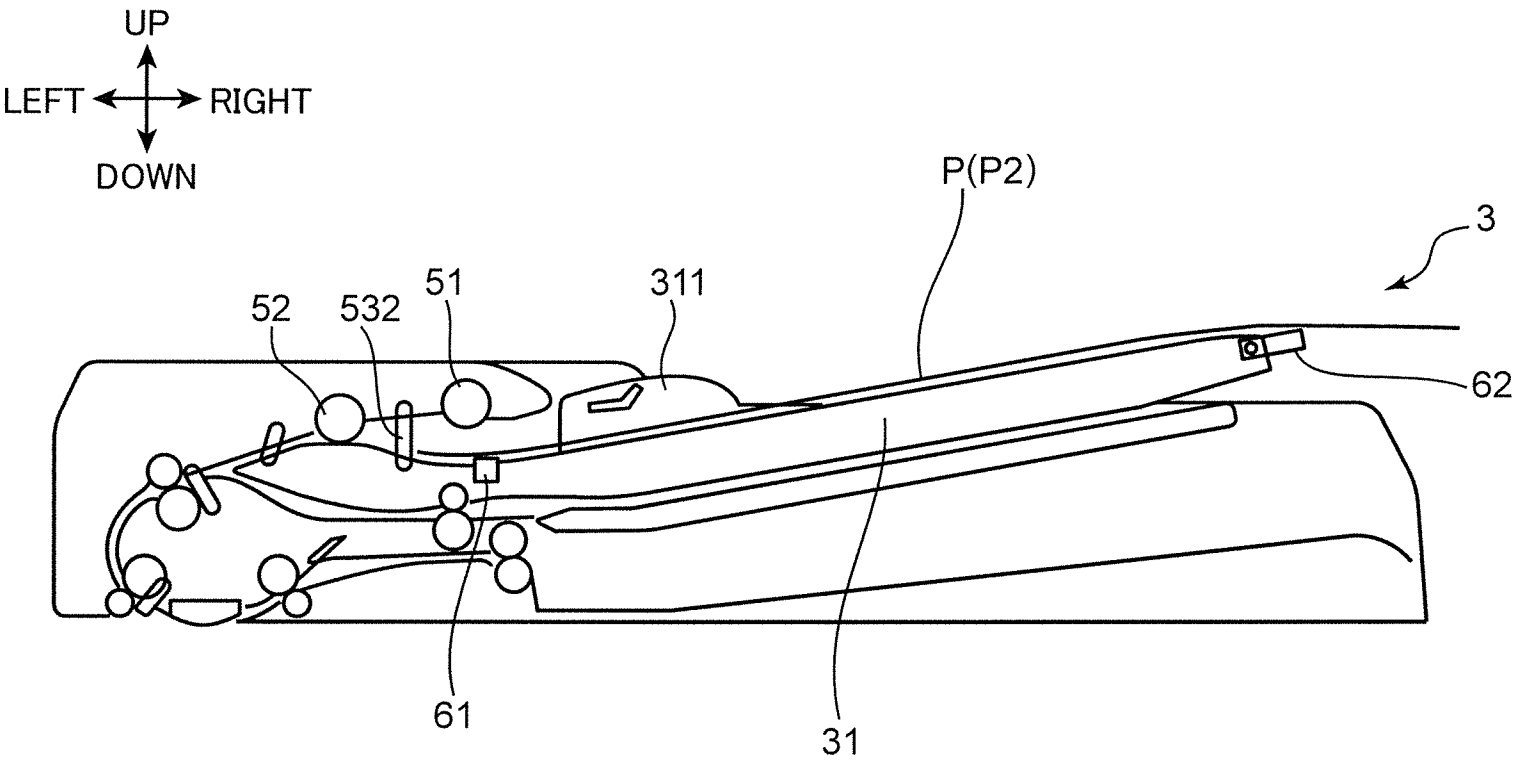
FIG. 8 is a schematic sectional view showing a state where a sheet with a second length is placed on a tray of an automatic document feeder according to an embodiment of the present invention.
Figure 9:
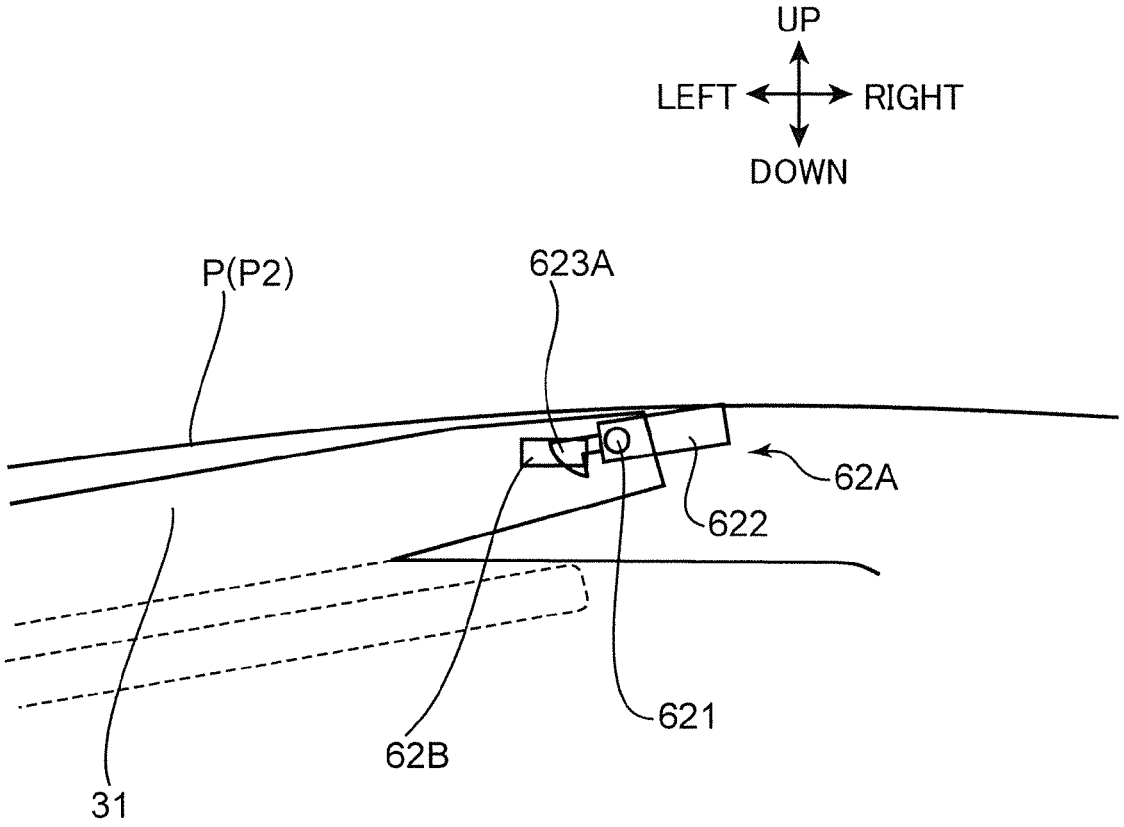
FIG. 9 is a schematic sectional view showing a situation of a second detection section in the state shown in FIG. 8.
Figure 10:
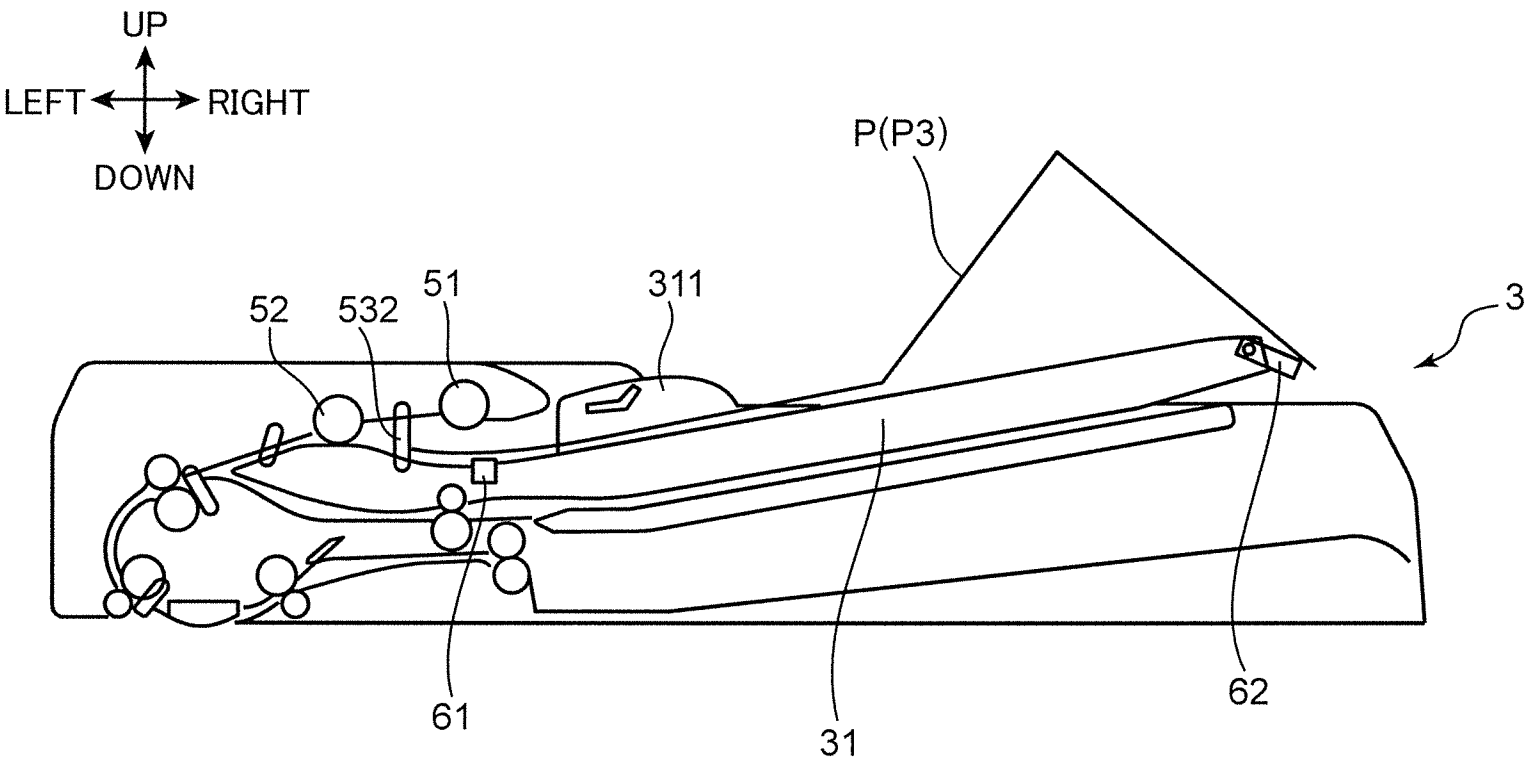
FIG. 10 is a schematic sectional view showing a situation where a partially-bent sheet with a second length is placed on a tray of an automatic document feeder according to an embodiment of the present invention.
Figure 11:
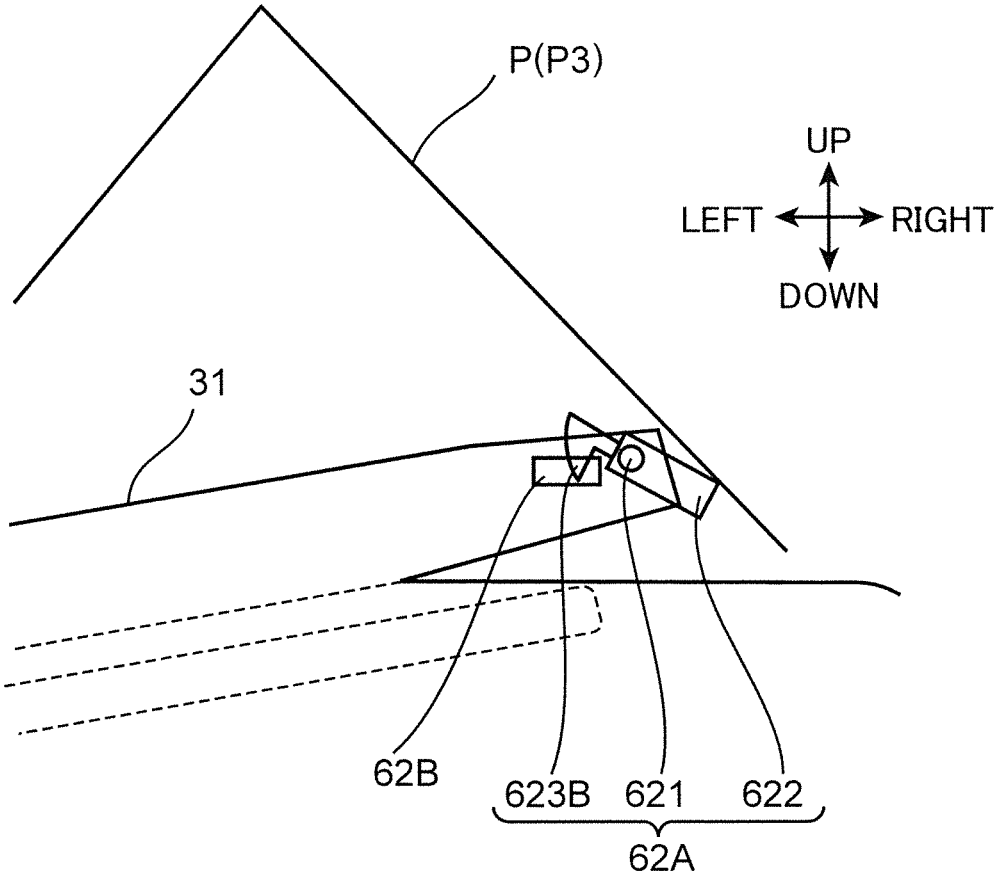
FIG. 11 is a schematic sectional view showing a situation of a second detection section in the state shown in FIG. 10.

The present embodiment is provided with the trailing end detection switch 62 described earlier in order to solve this problem. FIG. 6 is a schematic sectional view for explaining a structure of the trailing end detection switch 62 according to the present embodiment. FIG. 7 is a schematic sectional view showing a state where a sheet P1 with a first length is placed on the document feed tray 31 of the automatic document feeder 3 according to the present embodiment. FIG. 8 is a schematic sectional view showing a state where a sheet P2 with a second length is placed on the document feed tray 31 of the automatic document feeder 3. FIG. 9 is a schematic sectional view showing a situation of the trailing end detection switch 62 in the state shown in FIG. 8. FIG. 10 is a schematic sectional view showing a state where a partially-bent sheet P3 with the second length is placed on the document feed tray 31 of the automatic document feeder 3. FIG. 11 is a schematic sectional view showing a situation of the trailing end detection switch 62 in the state shown in FIG. 10.

Referring to FIG. 6, the trailing end detection switch 62 is a pressure-type sensor which detects a document sheet placed on the placement surface 31S of the document feed tray 31 by being pressed against the document sheet. As the document sheet placed on the placement surface 31S presses the trailing end detection switch 62, the trailing end detection switch 62 can detect a trailing end side in the conveyance direction of the document sheet. The trailing end detection switch 62 includes an actuator 62A, a detection sensor 62B, and a biasing member (not shown).

The actuator 62A is arranged in a slit (not shown) formed at an end section on a trailing end side in the conveyance direction of the document feed tray 31. The actuator 62A includes a rotation fulcrum 621, an abutting section 622 (a pressed section), and a detected piece 623 (a shielding plate). The rotation fulcrum 621 is a rotary shaft arranged at the end section on the trailing end side in the conveyance direction of the document feed tray 31. The abutting section 622 is a rod-like member provided extending from the rotation fulcrum 621 so as to protrude from the document feed tray 31. The abutting section 622 is pressed by a document sheet placed on the placement surface 31S. The detected piece 623 is provided extending from the rotation fulcrum 621 toward an opposite side to the abutting section 622. Moreover, the detected piece 623 need only be provided extending from the rotation fulcrum 621 in a different direction with respect to the abutting section 622. As shown in FIG. 6, the detected piece 623 is provided extending with a predetermined width from an end section of the abutting section 622 on the side of the rotation fulcrum 621, and a fan-shaped member is arranged at a tip section of the detected piece 623. In the present embodiment, the detected piece 623 has a fan-like shape with an apex angle of approximately 90 degrees. One side edge of the detected piece 623 is arranged so as to oppose the rotation fulcrum 621 and another side edge is arranged so as to extend from the rotation fulcrum 621 in a radial direction. In addition, a first corner section 623A (FIG. 9) and a second corner section 623B (FIG. 11) are respectively formed at both end sections of the arc portion. The actuator 62A is configured so as to rotatable around the rotation fulcrum 621 inside the slit.

The detection sensor 62B is a light transmission-type sensor (PI sensor) arranged inside the document feed tray 31. The detection sensor 62B includes a light emitting section and a light receiving section (both not shown). The detected piece 623 is configured to be enterable between the light emitting section and the light receiving section. The detection sensor 62B can detect the detected piece 623 as the detected piece 623 shields detection light emitted from the light emitting section with rotation of the actuator 62A.

The biasing member is a coil spring arranged at the rotation fulcrum 621. The biasing member biases the actuator 62A around the rotation fulcrum 621 so that, in a first state (refer to FIG. 5) where a document sheet is not placed on the placement surface 31S, the abutting section 622 assumes a posture of protruding upward from the document feed tray 31. Moreover, in the present embodiment, the abutting section 622 protrudes upward and rightward in the first state. Specifically, in a sectional view (FIG. 6) of the first state in a sheet width direction that intersects with the conveyance direction of a document sheet, a first angle θ1 formed between a direction in which the abutting section 622 is extended from the rotation fulcrum 621 and the placement surface 31S of the document feed tray 31 is set to 135 degrees. Moreover, as described later, the first angle θ1 is desirably set to 90 degrees or larger and smaller than 180 degrees and more desirably set to 135 degrees or larger and smaller than 180 degrees.

Referring to FIG. 7, the sheet P1 with the first length is placed on the document feed tray 31. For example, the sheet P1 is an A4 size document sheet. The sheet P1 is placed on the document feed tray 31 so that a longitudinal portion is aligned in a sheet width direction (front-rear direction). At this point, the leading end detection switch 61 detects a leading end section in the conveyance direction of the sheet P1. Meanwhile, as shown in FIG. 7, a trailing end section in the conveyance direction of the sheet P1 is positioned on a leading end side in the conveyance direction with respect to the trailing end detection switch 62. Therefore, the sheet P1 does not press the trailing end detection switch 62 downward. In this case, the detected piece 623 of the actuator 62A is arranged separated from the detection sensor 62B. As a result, a control section (not shown) detects that the sheet P1 is placed on the document feed tray 31 based on an ON signal output from the leading end detection switch 61 and an OFF signal output from the detection sensor 62B of the trailing end detection switch 62.

Meanwhile, referring to FIGS. 8 and 9, the sheet P2 with the second length that is longer than the first length is placed on the document feed tray 31. For example, the sheet P2 is an A3 size document sheet. The sheet P2 is placed on the document feed tray 31 so that a longitudinal portion is aligned in a conveyance direction (left-right direction). At this point, the leading end detection switch 61 detects a leading end section in the conveyance direction of the sheet P2. Furthermore, from the state shown in FIG. 6, the abutting section 622 of the actuator 62A is pressed downward by an end section on a trailing end side in the conveyance direction of the sheet P2 placed on the placement surface 31S (a second state) as shown in FIG. 9. As a result, as the actuator 62A rotates around the rotation fulcrum 621, the first corner section 623A of the detected piece 623 is detected by the detection sensor 62B (FIG. 9). Subsequently, the control section (not shown) detects that the sheet P2 is placed on the document feed tray 31 based on an ON signal output from the leading end detection switch 61 and an ON signal output from the detection sensor 62B of the trailing end detection switch 62.

Furthermore, with reference to FIGS. 10 and 11, the sheet P3 which has the second length and which is partially bent on a trailing end side is placed on the document feed tray 31. In other words, the sheet P3 is placed on the placement surface 31S of the document feed tray 31 in a state where a crease made by a Z-fold remains.

In this case, as shown in FIG. 10, the leading end detection switch 61 detects a leading end section in the conveyance direction of the sheet P3. Furthermore, from the state shown in FIG. 6, the abutting section 622 of the actuator 62A is pressed downward by an end section on a trailing end side in the conveyance direction of the sheet P3 placed on the placement surface 31S (the second state) as shown in FIG. 11. As a result, as the actuator 62A rotates around the rotation fulcrum 621, the second corner section 623B of the detected piece 623 is detected by the detection sensor 62B (FIG. 9). Subsequently, the control section (not shown) detects that the sheet P3 is placed on the document feed tray 31 based on an ON signal output from the leading end detection switch 61 and an ON signal output from the detection sensor 62B of the trailing end detection switch 62. Therefore, the fact that a document sheet with a large size has been placed on the placement surface 31S is detected by the detection sensor 62B of the trailing end detection switch 62 in a stable manner. Additionally, regarding the states of the actuator 62A described above, the actuator 62A is rotated more largely around the rotation fulcrum 621 when the bent sheet P3 is placed on the placement surface 31S as compared to when the sheet P2 is placed on the placement surface 31S. In the present embodiment, the detected piece 623 is provided with the first corner section 623A and the second corner section 623B in order to enable the detection sensor 62B to accurately detect the detected piece 623 even when the bent sheet P3 is placed on the placement surface 31S.

As described above, according to the present embodiment, document sheets of different sizes can be detected based on detection results of the leading end detection switch 61 and the trailing end detection switch 62. Furthermore, the trailing end detection switch 62 is arranged at the end section on the trailing end side in the conveyance direction of the document feed tray 31. Therefore, even when a large-size sheet (the sheet P3) is placed on the placement surface 31S in a state where a crease made by a Z-fold remains, the trailing end detection switch 62 can detect a trailing end section of the sheet P3.

Moreover, referring to FIG. 6, the first angle θ1 formed between the direction in which the abutting section 622 is extended from the rotation fulcrum 621 and the placement surface 31S of the document feed tray 31 is desirably set to 90 degrees or larger and smaller than 180 degrees. In this case, the trailing end detection switch 62 can detect the trailing end side in the conveyance direction of a document sheet even when a large-size document sheet is placed on the placement surface 31S or even when a crease made by a Z-fold remains on the sheet. In particular, by setting the first angle θ1 to 90 degrees or larger, the abutting section 622 is rotated in a stable manner when the sheet P2 or the bent sheet P3 is placed on the placement surface 31S. In addition, by setting the first angle θ1 to smaller than 180 degrees, an occurrence of an erroneous detection due to the abutting section 622 not rotating can be prevented when the sheet P2 is placed on the placement surface 31S. Furthermore, the first angle θ1 is desirably set to 135 degrees or larger and smaller than 180 degrees. In this case, the abutting section 622 is rotated in a more stable manner when the sheet P2 or the bent sheet P3 is placed on the placement surface 31S.

In addition, in the present embodiment, the length of the placement surface 31S of the document feed tray 31 in the conveyance direction is set longer than the length of the first sheet P1 that is placed on the placement surface 31S and shorter than the length of the second sheet P2 that is longer than the length of the first sheet P1 placed on the placement surface 31S. Therefore, the first sheet P1 and the second sheet P2 can be detected as document sheets with different sizes.

Furthermore, a distance from the stopper piece 532 (FIG. 4) to the trailing end detection switch 62 in the conveyance direction of a document sheet is set longer than 210 mm and shorter than 420 mm. In other words, the distance from the stopper piece 532 (FIG. 4) to the trailing end detection switch 62 is longer than an A4 size (the first sheet) and shorter than an A3 size (the second sheet) to be placed on the placement surface 31S. In this case, an A4 sheet and an A3 sheet can be detected in a stable manner as document sheets with different sizes. In addition, even when a crease made by a Z-fold remains on an A3 sheet, the trailing end detection switch 62 can detect a trailing end side in the conveyance direction of the A3 sheet.

Moreover, the distance from the stopper piece 532 (FIG. 4) to the trailing end detection switch 62 is desirably set shorter than 315 mm. An A3 size document sheet (the sheet P3) on which a crease made by a Z-fold remains is often placed on the placement surface 31S in a state where a mountain shape maintains an approximately equilateral triangle in a sectional view. In this case, the distance from the stopper piece 532 to the trailing end section in the conveyance direction of the sheet P3 is about 315 mm, which is the sum of 210 mm (a leading end side in the conveyance direction) and 105 mm (a bent portion on a trailing end side in the conveyance direction). Therefore, by setting the distance between the stopper piece 532 (FIG. 4) to the trailing end detection switch 62 as described above, the abutting section 622 is reliably pressed by the trailing end section of the bent sheet P3. As a result, even when a crease made by a Z-fold remains on an A3 sheet, the trailing end detection switch 62 can reliably detect a trailing end side in the conveyance direction of the A3 sheet.

As shown, with the automatic document feeder 3 according to the embodiment described above and the image forming device 1 provided with the automatic document feeder 3, document sheets of different sizes which are placed on the placement surface 31S of the document feed tray 31 can be detected. In addition, even when a large-size document sheet is placed on the placement surface 31S in a state where a crease made by a Z-fold remains, the trailing end detection switch 62 can detect a trailing end section of the sheet. As a result, a stable image can be formed on sheets fed from the paper feed cassettes 211, 41, and 42 in accordance with a size of the document sheet. Moreover, the present invention is not limited to the embodiment described above and, for example, the following modified embodiments can be adopted.

(1) While an aspect in which the trailing end detection switch 62 includes the actuator 62A and the detection sensor 62B as a pressure-type sensor has been explained in the embodiment described above, the present invention is not limited thereto. The trailing end detection switch 62 may be a pressure sensor that detects a document sheet by being pressed by the document sheet. In this case, a sensor surface of the pressure sensor is desirably arranged so that an angle formed between a normal direction of a sensor surface of the pressure sensor and the placement surface 31S satisfies the magnitude of the first angle θ1 described earlier.

(2) In addition, while an aspect in which the automatic document feeder 3 includes the leading end detection switch 61 and the trailing end detection switch 62 has been explained in the embodiment described above, the present invention is not limited thereto. The automatic document feeder 3 may include a detection mechanism similar to the trailing end detection piece 65 shown in FIG. 13 in addition to the leading end detection switch 61 and the trailing end detection switch 62.

Figure 12:
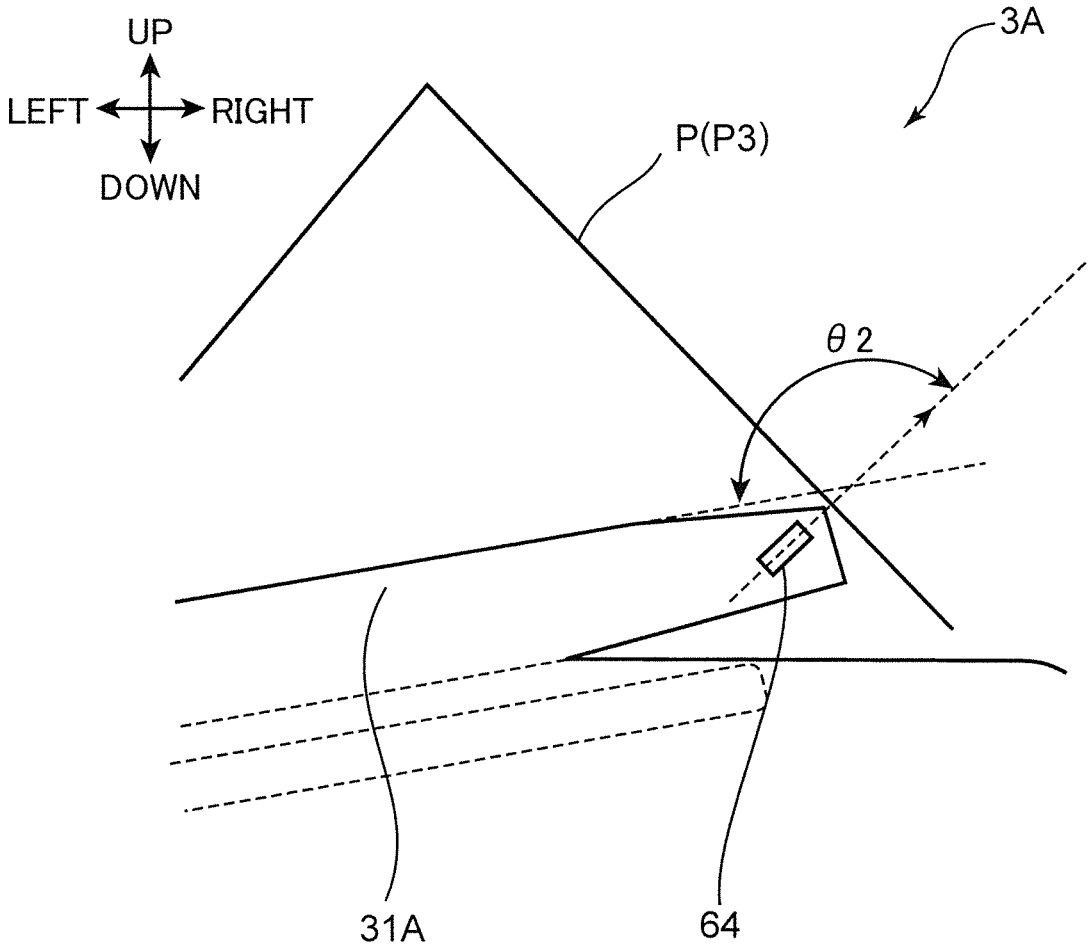
FIG. 12 is a schematic sectional view for explaining a structure of a second detection section according to a modified embodiment of the present invention.

(3) In addition, while an aspect in which the trailing end detection switch 62 is constituted by a pressure-type sensor has been explained in the embodiment described above, the present invention is not limited thereto. The trailing end detection switch 62 may be a light-reflecting sensor which emits detection light to a document sheet and which receives the detection light reflected by the document sheet. FIG. 12 is a schematic sectional view for explaining a structure of a trailing end light sensor 64 of an automatic document feeder 3A according to the present modified embodiment. The trailing end light sensor 64 (a second detection section) is arranged at a trailing end section in the conveyance direction of a document feed tray 31A. The trailing end light sensor 64 emits the detection light from an end section of the document feed tray 31A. Even with such a configuration, due to the detection light reflected by a document sheet being received by the trailing end light sensor 64, the trailing end light sensor 64 can detect a trailing end side in the conveyance direction of the document sheet. Therefore, even when a document sheet on which a crease made by a Z-fold remains is placed on the document feed tray 31A, the trailing end light sensor 64 can detect a trailing end section of the sheet in a stable manner. In addition, since the trailing end light sensor 64 is arranged at the end section on the trailing end side in the conveyance direction of the document feed tray 31A, a light-reflecting sensor with a relatively short detectable distance can be adopted. As a result, a cost of the trailing end light sensor 64 can be reduced.

Moreover, a second angle θ2 formed between a direction in which the trailing end light sensor 64 emits detection light and the placement surface of the document feed tray 31A in a sectional view (FIG. 12) in a sheet width direction that intersects with the conveyance direction of a document sheet is desirably set to 90 degrees or larger and smaller than 180 degrees. In this case, even when the large-size sheet P2 is placed on the placement surface or even when a crease made by a Z-fold remains on the large-size sheet P3, the trailing end light sensor 64 can accurately detect the trailing end side in the conveyance direction of the sheet.

(4) Furthermore, an aspect in which a biasing member (not shown) is arranged around the rotation fulcrum 621 has been explained in the embodiment described above. Due to the arrangement of such a biasing member, in the first state where a document sheet is not placed on the placement surface 31S, the abutting section 622 of the trailing end detection switch 62 is maintained in a posture protruding upward from the document feed tray 31. Therefore, when a document sheet is placed on the placement surface 31S, the document sheet can reliably press the abutting section 622. However, the present invention is not limited thereto.

The actuator 62A may be arranged in the posture described above based on the own weight of the actuator 62A or, in other words, based on a position of a center of gravity of the actuator 62A. In other words, in the first state where a document sheet is not placed on the placement surface 31S, rotational moment around the rotation fulcrum 621 is imparted to the actuator 62A due to the own weight of the actuator 62A. As a result, the actuator 62A is maintained in a posture in which the abutting section 622 protrudes upward from the document feed tray 31. Even in such a configuration, when a document sheet is placed on the placement surface 31S, the document sheet can reliably press the abutting section 622. In addition, the abutting section 622 may be constructed in an inexpensive manner as compared to a case where a biasing member such as that described above is provided.

The invention claimed is:

1. A sheet feeder, comprising:

a case;

a tray that is arranged in the case and that has a placement surface having an upper surface on which a sheet is placed;

a sheet conveyance path that extends from the tray in the case and through which the sheet is conveyed in a predetermined conveyance direction;

a paper feed member that is arranged on an entrance side of the sheet conveyance path and that conveys the sheet in the conveyance direction;

a first detection section that detects a leading end side in the conveyance direction of the sheet placed on the placement surface;

a second detection section that is arranged at an end section of the tray on a trailing end side in the conveyance direction and that detects a trailing end side in the conveyance direction of the sheet placed on the placement surface; and a restricting member that restricts a leading end edge of the sheet placed on the tray, wherein a distance from the restricting member to the second detection section in the conveyance direction is longer than 210 mm and shorter than 315 mm;

the second detection section is a pressure-type sensor that detects the sheet placed on the placement surface by being pressed by the sheet and includes:

an actuator that includes a rotation fulcrum arranged at an end section on the trailing end side of the tray in the conveyance direction, a pressed section extending from the rotation fulcrum so as to protrude from an end edge of the tray on the trailing end side of the tray and at an upstream side of the rotation fulcrum in the conveyance direction, the pressed section being pressed by the sheet placed on the placement surface, and a shielding plate extending from the rotation fulcrum in a direction that differs from a direction of extension of the pressed section from the rotation fulcrum, and the actuator being rotatable around the rotation fulcrum; and a detection sensor that is capable of detecting the shielding plate in conjunction with the rotation of the actuator.

2. The sheet feeder according to claim 1, further comprising a biasing member which biases the actuator around the rotation fulcrum so that the pressed section assumes a posture of protruding upward from the tray in a first state where the sheet is not placed on the placement surface.

3. The sheet feeder according to claim 1, wherein rotational moment around the rotation fulcrum is imparted to the actuator due to the actuator's own weight, and the actuator is maintained in a posture, in which the pressed section protrudes upward from the tray, in a first state where the sheet is not placed on the placement surface.

4. The sheet feeder according to claim 2, wherein a first angle formed between a direction, in which the pressed section extends from the rotation fulcrum, and the placement surface of the tray in a sectional view of the first state in a sheet width direction that intersects with the conveyance direction is set to 90 degrees or larger and smaller than 180 degrees.

5. The sheet feeder according to claim 4, wherein the first angle is set to 135 degrees or larger and smaller than 180 degrees.

6. The sheet feeder according to claim 2, wherein the shielding plate is arranged separated from the detection sensor in the first state, and the shielding plate is detected by the detection sensor due to rotation of the actuator around the rotation fulcrum in a second state where the pressed section is pressed by the trailing end side in the conveyance direction of the sheet placed on the placement surface.

7. An image forming device, comprising:

the sheet feeder according to claim 1 which conveys the sheet as a document;

an image reading section which is arranged so as to oppose a predetermined image reading position arranged on the sheet conveyance path and which reads a document image of the sheet; and an image forming section which forms an image on a sheet in accordance with the document image read by the image reading section.

8. The sheet feeder according to claim 1, wherein the pressed section can assume a posture of protruding upward and upstream relative to the conveyance direction from the end edge of the tray on the trailing end side in a state where the sheet is not placed on the placement surface.

9. The sheet feeder according to claim 1, wherein the pressed section can assume a posture of protruding downward and upstream relative to the conveyance direction from the end edge of the tray on the trailing end side when the pressed section is pressed by the sheet placed on the placement surface with a Z-fold.

* * * * *